US009141034B2

(12) United States Patent
Fukuda et al.

(10) Patent No.: US 9,141,034 B2
(45) Date of Patent: Sep. 22, 2015

(54) DEVELOPING DEVICE AND IMAGE FORMING APPARATUS AND PROCESS CARTRIDGE INCORPORATING SAME

(71) Applicants: Yoshiyuki Fukuda, Tokyo (JP); Yoshio Hattori, Kanagawa (JP); Sho Akiyama, Tokyo (JP); Noriyuki Kimura, Kanagawa (JP)

(72) Inventors: Yoshiyuki Fukuda, Tokyo (JP); Yoshio Hattori, Kanagawa (JP); Sho Akiyama, Tokyo (JP); Noriyuki Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/290,262

(22) Filed: May 29, 2014

(65) Prior Publication Data

US 2014/0356030 A1 Dec. 4, 2014

(30) Foreign Application Priority Data

May 31, 2013 (JP) ..... 2013-116431

(51) Int. Cl.
*G03G 15/09* (2006.01)
*G03G 21/18* (2006.01)

(52) U.S. Cl.
CPC ..... *G03G 15/09* (2013.01); *G03G 15/0942* (2013.01); *G03G 21/18* (2013.01)

(58) Field of Classification Search
CPC ..... G03G 15/09; G03G 15/0942; G03G 15/0817; G03G 15/0898; G03G 21/18
USPC ..... 399/103, 105, 267
See application file for complete search history.

(56) References Cited

U.S. PATENT DOCUMENTS

| | | | | |
|---|---|---|---|---|
| 4,733,267 | A | 3/1988 | Enoki et al. | |
| 2007/0242973 | A1* | 10/2007 | Yaji | 399/103 |
| 2008/0199210 | A1* | 8/2008 | Inaba et al. | 399/103 |
| 2009/0245887 | A1 | 10/2009 | Masuda et al. | |
| 2011/0058858 | A1 | 3/2011 | Fukuda et al. | |
| 2011/0217085 | A1 | 9/2011 | Hattori et al. | |
| 2012/0148313 | A1* | 6/2012 | Nose et al. | 399/269 |
| 2012/0163874 | A1 | 6/2012 | Hattori et al. | |
| 2012/0219326 | A1 | 8/2012 | Koike et al. | |

(Continued)

FOREIGN PATENT DOCUMENTS

| | | |
|---|---|---|
| JP | 60-010276 | 1/1985 |
| JP | 61-198260 | 9/1986 |
| JP | 10-123833 | 5/1998 |

(Continued)

OTHER PUBLICATIONS

Machine translation of JP 10-123833 (published on May 15, 1998) printed on Apr. 5, 2015.*
U.S. Appl. No. 14/106,413, filed Dec. 13, 2013.
U.S. Appl. No. 14/193,372, filed Feb. 28, 2014.

*Primary Examiner* — Sophia S Chen
(74) *Attorney, Agent, or Firm* — Duft Bornsen & Fettig LLP

(57) ABSTRACT

A developing device includes a developer bearer, a magnetic field generator provided inside the developer bearer, a casing including an opening to partly expose a surface of the developer bearer, and a lateral end cover to cover an axial end portion of the exposed surface of the developer bearer. The lateral end cover includes a wide portion extending more to an axial inner side of the developer bearer than a downstream portion of the lateral end cover positioned downstream from the wide portion in a direction of rotation of the developer bearer. A downstream end of the wide portion is downstream from an upstream end of the development range in the direction of rotation of the developer bearer.

12 Claims, 17 Drawing Sheets

(56) References Cited

U.S. PATENT DOCUMENTS

| | | | | |
|---|---|---|---|---|
| 2012/0269553 | A1* | 10/2012 | Yoshizawa et al. | 399/222 |
| 2013/0034368 | A1 | 2/2013 | Hattori et al. | |
| 2014/0153960 | A1* | 6/2014 | Handa et al. | 399/103 |

FOREIGN PATENT DOCUMENTS

| | | |
|---|---|---|
| JP | 2005-321762 | 11/2005 |
| JP | 2006-145815 | 6/2006 |
| JP | 2009-058944 | 3/2009 |

* cited by examiner

--Prior Art--

--Prior Art--

DEVELOPING DEVICE AND IMAGE FORMING APPARATUS AND PROCESS CARTRIDGE INCORPORATING SAME

CROSS-REFERENCE TO RELATED APPLICATION

This patent application is based on and claims priority pursuant to 35 U.S.C. §119(a) to Japanese Patent Application No. 2013-116431, filed on May 31, 2013, in the Japan Patent Office, the entire disclosure of which is hereby incorporated by reference herein.

BACKGROUND

1. Technical Field

Embodiments of the present invention generally relate to a developing device, a process cartridge, and an image forming apparatus, such as a copier, a printer, a facsimile machine, or a multifunction machine having at least two of coping, printing, facsimile transmission, plotting, and scanning capabilities, that includes a developing device.

2. Description of the Background Art

Generally, image forming apparatuses include a developing device to develop latent images formed on a latent image bearer with developer. For example, there are two-component developing devices that employ two-component developer consisting essentially of toner particles and carrier particles. In two-component developing devices, a casing to contain developer includes an opening to partly expose the surface of a developer bearer (such as a developing roller), and the exposed surface of the developing roller faces the surface of the latent image bearer (such as a photoreceptor). A magnetic field generator provided inside the developing roller generates a magnetic field to generate a magnetic brush of developer on the developing roller, and the magnetic brush contacts the photoreceptor in a range where the developing roller faces the photoreceptor. Thus, toner is supplied to the latent image on the photoreceptor, developing it into a toner image.

In such a developing device, the magnetic field generator inside the developing roller does not extend to the outer ends in the axial direction, and the magnetic brush is not generated on the surface of the developing roller in areas adjacent to the outer ends (hereinafter "axial end portions"). If the amount of charge is insufficient, toner in the developing device is not adsorbed to carrier and floats. The floating toner can be transported by airflow generated by rotation of the developing roller and scatter outside from the opening. The scattering of toner can result in contamination inside the apparatus and substandard images.

The developing device further includes a developer regulator (such as a doctor blade) disposed upstream from the opening in the direction of rotation of the developing roller. In the area on the surface of the developing roller where the magnetic brush is formed (hereinafter "magnetic brush area"), the magnetic brush fills in clearance between the developer regulator and the surface of the developing roller. This prevents toner borne on the airflow from passing through a gap (i.e., a regulation gap) between the developer regulator and the surface of the developing roller, thus preventing the occurrence of toner scattering.

By contrast, since clearance is present in the axial end portions of the developing roller, where magnetic brush is not present, toner borne on the airflow passes through the regulation gap. Then, the toner is transported along the surface of the developing roller to the opening and can scatter outside from the axial end portions of the opening.

To inhibit scattering of toner from the axial end portion of the opening, there are configurations (such as JP-S60-010276-A, JP-S61-198260-A, JP-2006-145815-A, and JP-2005-321762-A) in which a lateral end cover constructed of flexible, elastic sheet is used to cover the area adjacent to the axial end of the developing roller from the side of the photoreceptor facing the developing roller in the opening.

Such configurations using the lateral end cover can inhibit toner transported through the regulation gap by airflow from colliding against the face of the lateral end cover on the side of the developing roller and scattering outside through the opening.

For example, JP-560-010276-A proposes a configuration in which the lateral end cover covers, in addition to the portion where the magnetic brush is not present on the surface of the developing roller, an area adjacent to the axial end of the magnetic brush area so that the lateral end cover covers the portion where the magnetic brush is not present on the surface of the developing roller to inhibit toner from scattering through the axial end portion of the opening.

SUMMARY

In view of the foregoing, one embodiment of the present invention provides a developing device that includes a developer bearer to carry developer including magnetic carrier and toner to a development range where the developer bearer faces a latent image bearer; a magnetic field generator provided inside the developer bearer to generate a magnetic flux on the surface of the developer bearer; a casing including an opening to partly expose a surface of the developer bearer in the development range; and a lateral end cover to cover an axial end portion of the exposed surface of the developer bearer.

The lateral end cover includes a wide portion extending more to an axial inner side of the developer bearer than a downstream portion of the lateral end cover positioned downstream from the wide portion in a direction of rotation of the developer bearer. A downstream end of the wide portion is downstream from an upstream end of the development range in the direction of rotation of the developer bearer.

In another embodiment, a process cartridge removably installed in an image forming apparatus includes at least the latent image bearer, the developing device described above, and a common unit casing to house the components of the process cartridge.

In yet another embodiment, an image forming apparatus includes the latent image bearer; a charging member to charge a surface of the latent image bearer; and the developing device described above.

In yet another embodiment, a developing device includes the developer bearer; the magnetic field generator; the casing; and a cover means to cover to an axial end portion of the exposed surface of the developer bearer. The axial end portion is adjacent to the development range and astride a development pole center where density of the magnetic flux in a direction normal to the surface of the developer bearer is greatest. On an upstream side of the development pole center and downstream from an upstream end of the development range in a direction of rotation of the developer bearer, the cover means covers an area extending more to an axial inner side of the developer bearer than a downstream side of the development pole center.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
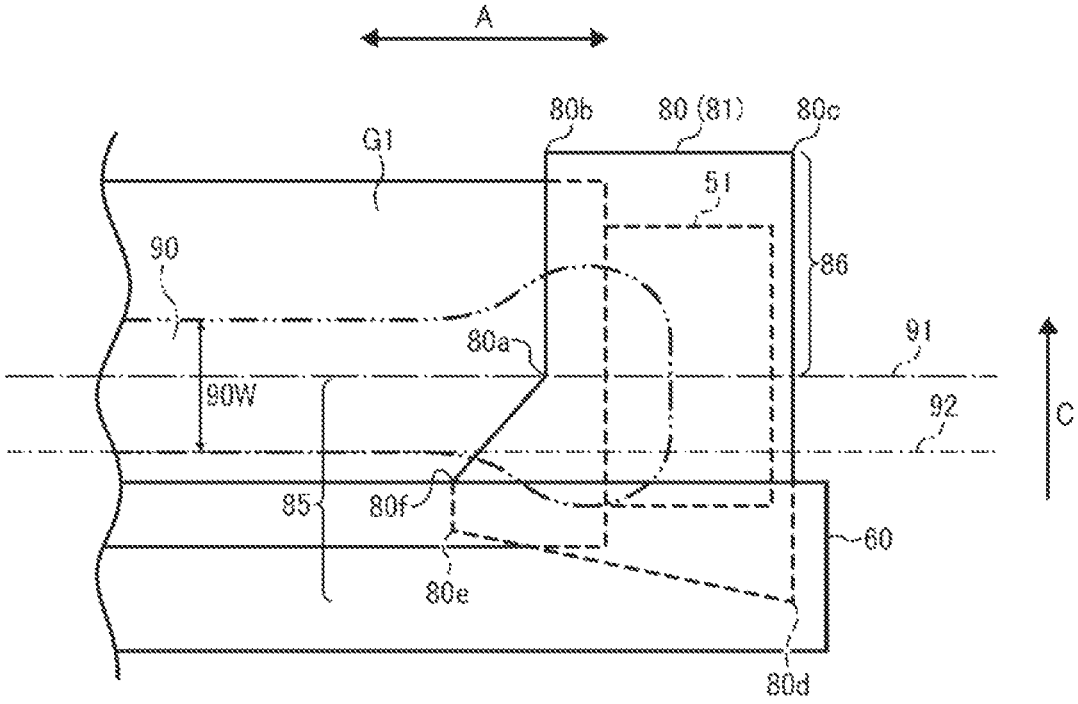
FIG. 1 is a schematic diagram illustrating an axial outer end portion of a developing sleeve for understanding of relative positions of a lateral end seal and a developing nip according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In the configuration in which the lateral end cover covers the area adjacent to the axial end of the magnetic brush area, however, it is possible that developer in the form of the magnetic brush enters between the lateral end cover and the surface of the photoreceptor. The following factors can be assumed to have caused this phenomenon.

In the area on the surface of the developing roller where the magnetic flux density in normal direction (hereinafter "normal direction magnetic flux density") is high, the magnetic brush stands along the normal direction. In the development range, to generate the magnetic brush that contributes to image development, a development pole center, where the normal direction magnetic flux density on the surface of the developing roller is greatest, is present adjacent to a center position of the development range in the direction of rotation of the developing roller.

As the developing roller rotates, developer carried thereon changes its posture upstream from the development pole center in the direction of rotation of the developing roller, that is, rises up from a leaning posture leading over the surface of the developing roller. Then, the end of the magnetic brush at the development pole center is positioned farther from the developing roller than the lateral end cover.

Additionally, adjacent to the axial end of the developing roller, a going-around magnetic field is generated. The term "going-around magnetic field" used here means a magnetic field that goes around from the surface of the developing roller to an axial end face of the magnetic field generator (or the magnetic pole generator). In the range where the going-around magnetic field is generated, the magnetic brush is inclined toward the outer side in the axial direction from the bottom to the upper end.

Additionally, the going-around magnetic field increases in strength as the position approaches to the development pole center. Accordingly, as the developing roller rotates, the magnetic brush of developer positioned adjacent to the axial end of the developing roller and upstream from the development pole center in the direction of rotation of the developing roller rises up with the end of the magnetic brush shifted further to the outer side in the axial direction.

Even when developer behaves as described above, developer being in the process of rising up contacts the face of the lateral end cover on the side of the developing roller in a case where the lateral end cover covers the bottom of the magnetic brush adjacent to the axial end of the developing roller. By contrast, in the area adjacent to the axial end of the developing roller, there are cases where the bottom of the magnetic brush is positioned inside the axial inner periphery of the lateral end cover and the bottom of the magnetic brush is not covered. In this case, it is possible that the magnetic brush being in the process of rising does not contact the lateral end cover, and the end of the magnetic brush is farther from the developing roller than the lateral end cover. Subsequently, it is possible that, due to the effect of the going-around magnetic field, the end of the magnetic brush is moved further to the outer side in the axial direction from the axial inner periphery of the lateral end cover. The developer at the end of the magnetic brush thus moved is interposed between the lateral end cover and the photoreceptor.

In this state, when the magnetic brush is broken by, for example, contact with the lateral end cover, developer is retained between the lateral end cover and surface of the photoreceptor. Then, developer adheres to the surface of the photoreceptor.

The developer in the form of the magnetic brush includes carrier, and carrier can adheres to the photoreceptor as well. The carrier adhering to the surface of the photoreceptor can damage the surface of the photoreceptor and a member, such as a transfer member, a charging member, and cleaning member, opposed to the photoreceptor.

Additionally, the inventors of the present invention have found that, even in the configuration in which the lateral end cover covers the axial end portion, carrier adhesion can be inhibited by increasing the lateral end cover in the axial length (i.e., width) to cover the magnetic brush. The following factors can be assumed to have caused this phenomenon.

The portion of the lateral end cover covering the magnetic brush is made relatively wide in the axial direction to entirely cover, on the surface of the developing roller, the bottom of the magnetic brush inclined due to the going-around magnetic field at the development pole center. With this configuration, while the magnetic brush is in the process of rising up upstream from the development pole center, the magnetic brush contacts the face of the lateral end cover on the side of the developing roller. Thus, this configuration can inhibit the end of the magnetic brush from entering between the lateral end cover and the surface of the photoreceptor and suppress carrier adhesion.

However, when the lateral end cover is provided to entirely cover the portion of the surface of the developing roller which is the bottom of the magnetic brush inclined due to the going-around magnetic field, the axial length of the range, out of the axial end portion of the developing roller, covered with the lateral end cover increases.

If the axial length of the range covered with the lateral end cover disposed adjacent to either axial end of the developing roller increases, an opening width between the lateral end covers at both ends is made longer than a widest developing width desired. Accordingly, the developing roller increases in axial size. Increases in axial size of the developing roller results in increases in axial size of the entire developing device.

In view of the foregoing, an aim of the embodiment described below is to provide a developing device and an image forming apparatus capable of inhibiting scattering of toner from axial ends and adhesion of carrier to the latent image bearer while inhibiting increases in axial size.

Referring now to the drawings, wherein like reference numerals designate identical or corresponding parts throughout the several views thereof, and particularly to FIG. 1, a multicolor image forming apparatus according to an embodiment of the present invention is described.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary. It is to be noted that the term "cylindrical" used in this specification is not limited to round columns but also includes polygonal prisms.

Figure 2:
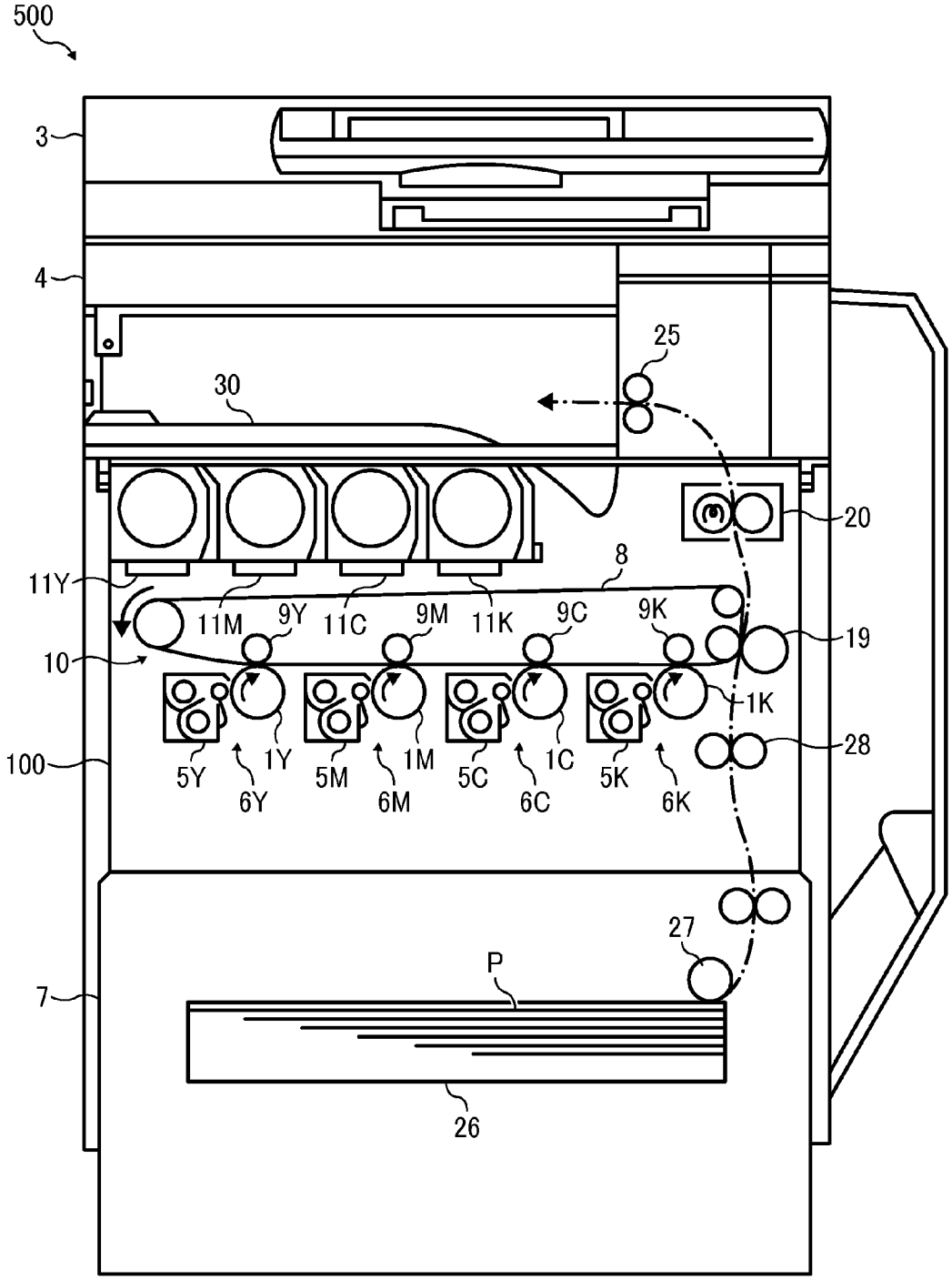
FIG. 2 is a schematic diagram illustrating an image forming apparatus according to an embodiment.

FIG. 2 is a schematic diagram that illustrates a configuration of an image forming apparatus 500 according to the present embodiment, which can be a tandem-type multicolor copier, for example.

The image forming apparatus 500 includes a printer unit 100 that is an apparatus body, a document reading unit 4 and a document feeder 3, both disposed above the printer unit 100, and a sheet feeding unit 7 disposed beneath the printer unit 100. The document feeder 3 feeds originals to the document reading unit 4, and the document reading unit 4 reads image data of the originals. The sheet feeding unit 7 is a sheet container that contains sheets P (transfer sheets) of recording media and includes a sheet tray 26 in which the sheets P are stored and a feed roller 27 to feed the sheets P from the sheet tray 26 to the printer unit 100. It is to be noted that broken lines shown in FIG. 1 represent a conveyance path through which the sheet P is transported inside the image forming apparatus 500.

A discharge tray 30 on which output images are stacked is provided on an upper side of the printer unit 100. The printer unit 100 includes four image forming units 6Y, 6M, 6C, and 6K for forming yellow, magenta, cyan, and black toner images, respectively, and an intermediate transfer unit 10. Each image forming unit 6 includes a drum-shaped photoreceptor 1 serving as an image bearer on which a toner image is formed, and a developing device 5 for developing an electrostatic latent image formed on the photoreceptor 1 into the toner image.

The intermediate transfer unit 10 includes four primary-transfer bias rollers 9Y, 8M, 9C, and 9K in addition to an intermediate transfer belt 8. The intermediate transfer belt 8 serves as an intermediate transfer member onto which the toner images are transferred from the respective photoreceptors 1, and the toner images are superimposed one on another thereon, thus forming a multicolor toner image. The primary-transfer bias rollers 9 serve as primary-transfer members to primarily transfer the toner images formed on the photoreceptors 1 onto the intermediate transfer belt 8.

The printer unit 100 further includes a secondary-transfer bias roller 19 to transfer the multicolor toner image from the intermediate transfer belt 8 onto the sheet P. Further, a pair of registration rollers 28 is provided to suspend the transport of the sheet P and adjust the timing to transport the sheet P to a secondary-transfer nip between the intermediate transfer belt 8 and the secondary-transfer bias roller 19 pressed against it. The printer unit 100 further includes a fixing device 20 disposed above the secondary-transfer nip to fix the toner image on the sheet P.

Additionally, toner containers 11Y, 11M, 11C, and 11K for containing respective color toners supplied to the developing devices 5 are provided inside the printer unit 100, beneath the discharge tray 30 and above the intermediate transfer unit 10.

Figure 3:
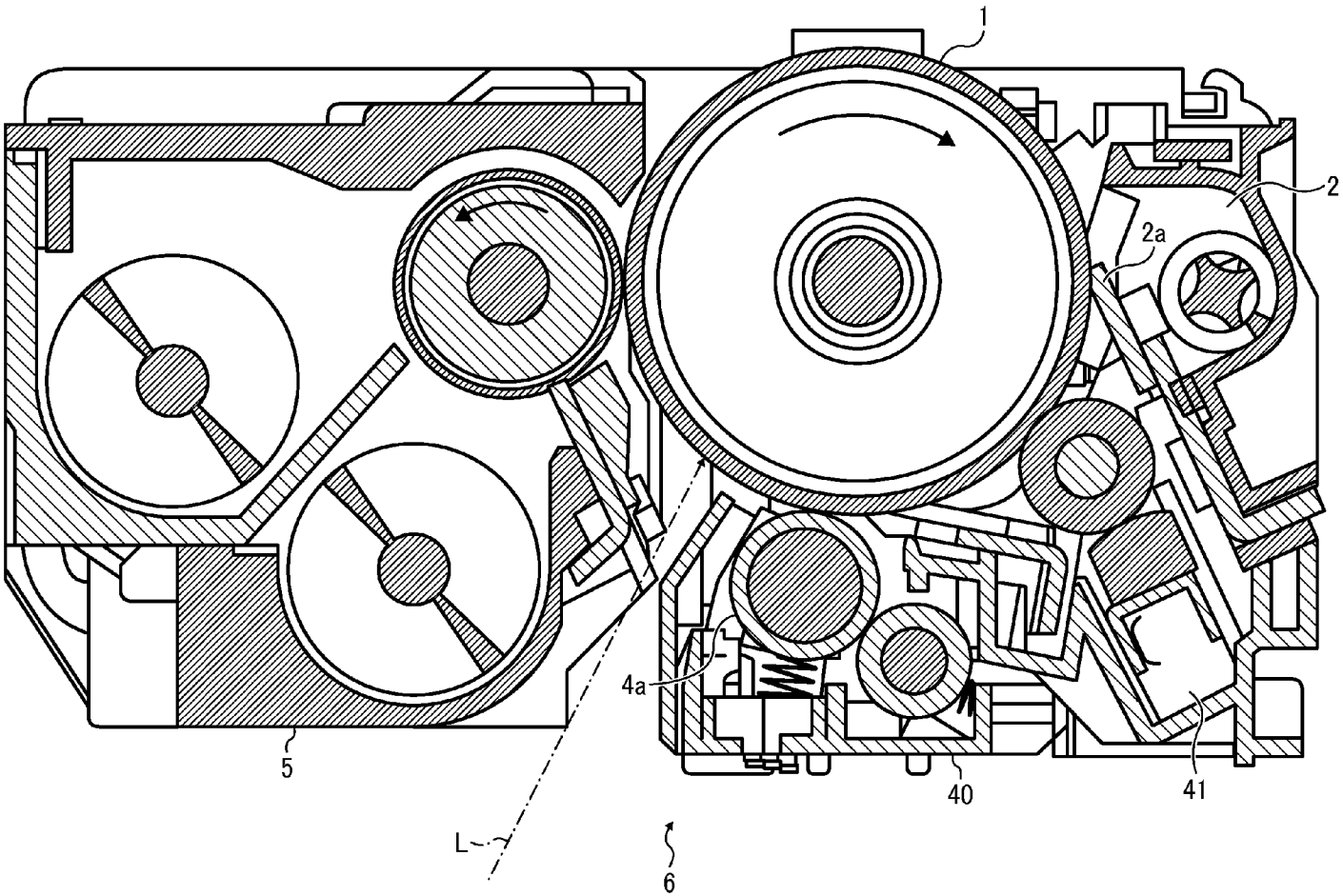
FIG. 3 is a schematic end-on axial view of an image forming unit of the image forming apparatus shown in FIG. 2.

FIG. 3 is an enlarged view of one of the four image forming units 6. The four image forming units 6 have a similar configuration except the color of toner used therein, and hereinafter the suffixes Y, M, C, and K may be omitted when color discrimination is not necessary.

As shown in FIG. 3, the image forming unit 6 includes a common unit casing to support the photoreceptor 1 and the developing device 5 and is configured as a modular unit (i.e., a process cartridge) removably installable in the apparatus body of the image forming apparatus 500. This configuration can facilitate replacement of the developing device 5 in the apparatus body, thus facilitating maintenance work.

Additionally, the image forming unit 6 includes a cleaning unit 2, a charging device 40, and a lubrication device 41 positioned around the photoreceptor 1 in addition to the developing device 5. In the image forming unit 6 according to the present embodiment, the cleaning unit 2 employs a cleaning blade 2*a*, and the charging device 40 employs a charging roller 4*a*.

Operations of the image forming apparatus 500 shown in FIG. 2 to form multicolor images are described below.

When users press a start button with originals set on a document table of the document feeder 3, conveyance rollers provided in the document feeder 3 transport the originals from the document table onto an exposure glass (contact glass) of the document reading unit 4. Then, the document reading unit 4 reads image data of the original set on the exposure glass optically.

More specifically, the document reading unit 4 scans the image of the original with light emitted from an illumination lamp. The light reflected from the surface of the original is imaged on a color sensor via mirrors and lenses. The color sensor reads the multicolor image data of the original for each of decomposed colors of red, green, and blue (RGB), and converts the image data into electrical image signals. Further, the image signals are transmitted to an image processor that performs image processing (e.g., color conversion, color calibration, and spatial frequency adjustment) according to the image signals, and thus image data of yellow, magenta, cyan, and black are obtained.

Then, the image data of yellow, magenta, cyan, and black are transmitted to a writing unit (i.e., an exposure device). Then, the exposure device directs laser beams L to the respective photoreceptors 1 according to image data of respective colors.

Meanwhile, the four photoreceptors 1 rotate clockwise in FIGS. 2 and 3. The surface of the photoreceptor 1 is charged uniformly at a position facing the charging roller 4*a* of the charging device 40 (a charging process). Thus, charge potentials are given to the surface of each photoreceptor 1. Subsequently, the surface of the photoreceptor 1 thus charged reaches a position to receive the laser beam L.

Then, the laser beams L according to the respective color image data are emitted from four light sources of the exposure device. The laser beams pass through different optical paths for yellow, magenta, cyan, and black and reach the surfaces of the respective photoreceptors 1 (an exposure process).

The laser beam L corresponding to the yellow component is directed to the photoreceptor 1Y that is the first from the left in FIG. 2 among the four photoreceptors 1. A polygon mirror that rotates at high velocity deflects the laser beam L for yellow in a direction of a rotation axis of the photoreceptor 1Y (main scanning direction) so that the laser beam L scans the surface of the photoreceptor drum 1Y. With the scanning of the laser beam L, an electrostatic latent image for yellow is formed on the photoreceptor 1Y charged by the charging device 40.

Similarly, the laser beam L corresponding to the magenta component is directed to the surface of the photoreceptor 1M that is the second from the left in FIG. 2, thus forming an electrostatic latent image for magenta thereon. The laser beam L corresponding to the cyan component is directed to the surface of the photoreceptor 1C that is the third from the left in FIG. 2, thus forming an electrostatic latent image for cyan thereon. The laser beam L corresponding to the black component is directed to the surface of the photoreceptor 1K that is the fourth from the left in FIG. 2, thus forming an electrostatic latent image for black thereon.

Subsequently, the surface of the photoreceptor 1 where the electrostatic latent image is formed is further transported to the position facing the developing device 5. The developing device 5 contains developer including toner (toner particles) and carrier (carrier particles) and supplies toner to the surface of the photoreceptor 1, developing the latent image thereon (a development process) into a single-color toner image.

Then, the surfaces of the respective photoreceptors 1 reach positions facing the intermediate transfer belt 8, where the respective primary-transfer bias rollers 9 are provided in contact with an inner circumferential surface of the intermediate transfer belt 8 The primary-transfer bias rollers 9 face the respective photoreceptors 1 via the intermediate transfer belt 8, thus forming primary-transfer nips, where the single-color toner images are transferred from the respective photoreceptors 1 and superimposed one on another on the intermediate transfer belt 8 (a transfer process).

Subsequently, the surface of the photoreceptor 1 reaches a position facing the cleaning unit 2, where the cleaning blade 2*a* scraps off toner remaining on the photoreceptor 1 (a cleaning process).

Additionally, the surface of each photoreceptor 1 passes through a discharge section facing a discharger, and electrical potentials remaining on the surface of the photoreceptor 1 are removed. Thus, a sequence of image forming processes performed on each photoreceptor 1 is completed, and the photoreceptor 1 is prepared for subsequent image formation.

Meanwhile, the intermediate transfer belt 8 carrying the superimposed single-color toner images (a multicolor toner image) transferred from the four photoreceptors 1 rotates counterclockwise in FIG. 2 and reaches a position facing the secondary-transfer bias roller 19.

Additionally, the feed roller 27 sends out the sheet P from the sheet tray 26, and the sheet P is then guided by a sheet guide to the registration rollers 28. The sheet P is caught in the nip between the registration rollers 28 and stopped. Then, the registration rollers 28 forward the sheet P to the secondary-transfer nip, timed to coincide with the multicolor toner on the intermediate transfer belt 8.

In the secondary-transfer nip, the multicolor toner image is transferred from the intermediate transfer belt 8 onto the sheet P (a secondary-transfer process).

Subsequently, the intermediate transfer belt 8 reaches a position facing the belt cleaning unit including a belt cleaning blade 18 (shown in FIG. 17), where toner remaining on the intermediate transfer belt 8 is collected by the belt cleaning unit. Thus, a sequence of transfer processes performed on the intermediate transfer belt 8 is completed.

The sheet P carrying the multicolor toner image is sent to the fixing device 20. In the fixing device 20, a fixing belt and a pressing roller are pressed against each other, forming a fixing nip, where the toner image is fixed on the sheet P with heat and pressure (i.e., a fixing process).

Then, the sheet P is transported by a pair of discharge rollers 25 and discharged outside the printer unit 100 as an output image onto the discharge tray 30. Thus, a sequence of image forming processes is completed.

Figure 4:
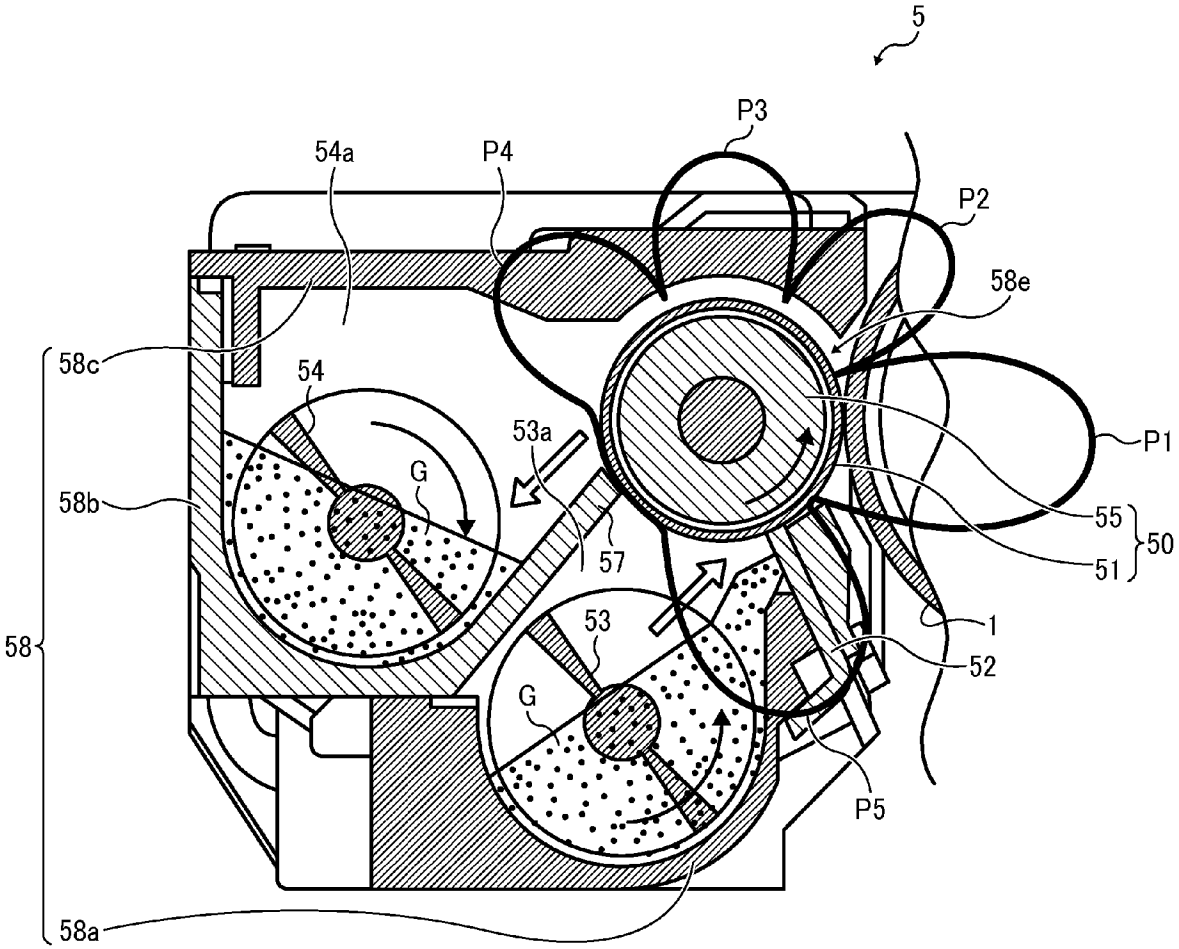
FIG. 4 is an end-on axial view of a developing device according to an embodiment.

FIG. 4 is a cross-sectional view of the developing device 5 according to the present embodiment. The developing device 5 includes a casing 58 to contain developer. The casing 58 includes a lower case 58*a*, an upper case 58*b*, and a development cover 58*c*.

Figure 5:
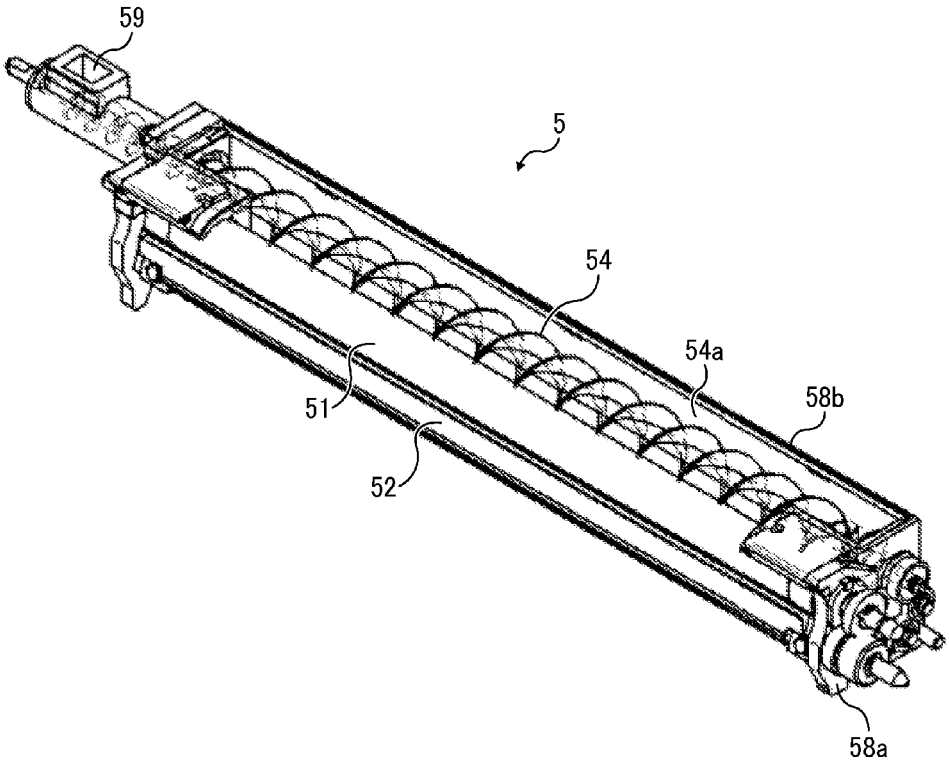
FIG. 5 is a perspective view of the developing device shown in FIG. 4.

FIG. 5 is a perspective view illustrating the developing device 5 from which the development cover 58*c* is removed.

The developing device 5 includes a developing roller 50 serving as a developer bearer disposed facing the photoreceptor 1, multiple developer conveyance members, namely, a supply screw 53 and a collecting screw 54, a doctor blade 52 serving as a developer regulator, and a partition 57. The supply screw 53 and the collecting screw 54 may be screw members each including a rotary shaft and a spiral blade winding around the rotary shaft and transport developer in an axial direction by rotating.

The casing 58 includes a development opening 58*e* to partly expose the surface of the developing roller 50 in a development range where the developing roller 50 faces the photoreceptor 1.

The doctor blade 52 is disposed facing the developing roller 50 and adjusts the amount of developer carried on the surface of the developing roller 50.

A circulation channel through which developer is agitated and transported in the longitudinal direction is established by the multiple developer conveyance members, namely, the supply screw 53 and the collecting screw 54. The supply screw 53 faces the developing roller 50 and supplies developer to the developing roller 50 while transporting the developer in the longitudinal direction. The collecting screw 54 transports developer while mixing the developer with supplied toner.

The partition 57 divides, at least partly, an interior of the casing 58 into a supply channel 53*a* in which the supply screw 53 is provided and a collecting channel 54*a* in which the collecting screw 54 is provided. Additionally, on the cross section (shown in FIG. 4) perpendicular to the axial direction, an end face of the partition 57 faces the developing roller 50 and positioned adjacent to the developing roller 50. Thus, the partition 57 can also serve as a separator to facilitate separation of developer from the surface of the developing roller 50. The partition 57 having the separating capability can inhibit the developer that has passed through the development range, carried on the developing roller 50, from reaching the supply channel 53*a*. Thus, the developer is not retained but can move to the collecting channel 54*a*.

The developing roller 50 includes a magnet roller 55 including multiple stationary magnets and a developing sleeve 51 that rotates around the magnet roller 55. The developing sleeve 51 is a rotatable, cylindrical member constructed of a nonmagnetic material. The magnet roller 55 is housed inside the developing sleeve 51. The magnet roller 55 generates, for example, five magnetic poles, first through fifth poles P1 through P5. The first and third poles P1 and P3 are south (S) poles, and the second, fourth, and fifth poles P2, P4, and P5 are north (N) poles, for example. It is to be noted that bold petal-like lines with reference characters P1 through P5 in FIG. 4 represent density distribution (absolute value) of magnetic flux generated by the respective magnetic poles on the developing sleeve 51 in a direction normal to the surface of the developing sleeve 51.

The developing device 5 contains two-component developer consisting essentially of toner and carrier (one or more additives may be included). The supply screw 53 and the collecting screw 54 transport developer in the longitudinal direction (axial direction of the developing sleeve 51), and thus a developer circulation path is established inside the developing device 5. Additionally, the supply screw 53 and the collecting screw 54 are arranged vertically, and the supply channel 53*a* and the collecting channel 54*a* are divided from each other with the partition 57 disposed between the two developer conveyance members.

Additionally, the doctor blade 52 is provided beneath the developing roller 50 in FIG. 4 and upstream in the direction of rotation of the developing sleeve 51 from the development range where the developing roller 50 faces the photoreceptor 1. The doctor blade 52 adjusts the amount of developer conveyed to the development range, carried on the developing sleeve 51.

Further, a toner supply inlet 59 is in the developing device 5 to supply toner to the developing device 5 in response to consumption of toner because two-component developer is used in the present embodiment. While being transported, the supplied toner (e.g., reference G as shown in FIG. 4) is agitated and mixed with the developer exiting in the developing device 5 by the collecting screw 54 and the supply screw 53. The developer thus agitated is partly supplied to the surface of the developing sleeve 51 serving as the developer bearer and carried thereon. After the doctor blade 52 disposed beneath the developing sleeve 51 adjusts the amount of the developer, the developer is transported to the development range. In the development range, toner in the developer on the developing sleeve 51 adheres to the latent image formed on the surface of the photoreceptor 1. The magnet roller 55 provided with the multiple stationary magnets is inside the developing sleeve 51, and the magnet roller 55 has the multiple magnetic poles PI through P5 for generating magnetic fields around the developing sleeve 51.

For example, the developing device 5 according to the present embodiment is filled with 300 g of developer in which toner particles, including polyester resin as a main ingredient, and magnetic carrier particles are mixed uniformly so that the concentration of toner in developer is about 7% by weight. The toner has an average particle diameter of about 5.8 μm, and the magnetic carrier has an average particle diameter of about 35 μm. The supply screw 53 and the collecting screw 54 arranged in parallel are rotated at a velocity of about 600 revolutions per minute (rpm), thereby transporting the developer while mixing toner and carrier and charging the toner. Additionally, toner supplied through the toner supply inlet 59 is agitated in the developer by rotating the supply screw 53 and the collecting screw 54 to make the content of toner in the developer uniform.

While being transported in the longitudinal direction by the supply screw 53 positioned adjacent to and parallel to the developing sleeve 51, the developer in which toner and carrier are mixed uniformly is attracted by the fifth pole P5 of the magnet roller 55 inside the developing sleeve 51 and carried on the outer circumferential surface of the developing sleeve 51. The developer carried on the developing sleeve 51 is transported to the development range as the developing sleeve 51 rotates counterclockwise as indicated by an arrow shown in FIG. 4.

The developing sleeve 51 receives voltage from a high-voltage power source, and thus a development field (electrical field) is generated between the developing sleeve 51 and the photoreceptor 1 in the development range. With the development field, toner in developer carried on the surface of the developing sleeve 51 is supplied to the latent image formed on the surface of the photoreceptor 1, developing it.

The developer on the developing sleeve 51 that has passed through the development range is collected in the collecting channel 54*a* as the developing sleeve 51 rotates. Specifically, the developer falls from the developing sleeve 51 to an upper face of the partition 57, slides down the partition 57, and then is collected by the collecting screw 54.

Figure 6:
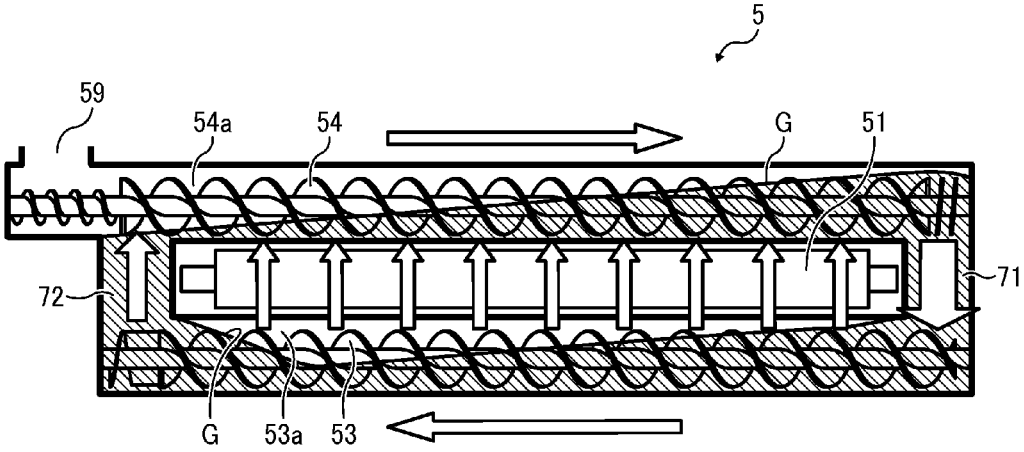
FIG. 6 is a schematic diagram illustrating movement of developer in the longitudinal direction inside the developing device shown in FIG. 4.

FIG. 6 is a schematic diagram illustrating movement of developer (e.g., reference G in FIG. 6) in the longitudinal direction (axial direction) inside the developing device 5. In FIG. 6, outlined arrows indicate the flow of developer in the developing device 5. Although the partition 57 is not shown in FIG. 6 for simplicity, openings (a developer-falling opening 71 and a developer lifting opening 72) are in end portions of the partition 57 in the longitudinal direction of the developing device 5, thus forming communication portions between the supply channel 53*a* and the collecting channel 54*a*.

As shown in FIG. 6, at the downstream end of the supply channel 53*a* in the direction in which the developer is transported (hereinafter "developer conveyance direction") by the supply screw 53, developer is transported up through the developer-lifting opening 72 in the partition 57 to the upstream end the collecting channel 54*a* in the developer conveyance direction therein. By contrast, at the downstream end of the collecting channel 54*a* in the developer conveyance direction by the collecting screw 54, developer is transported through the developer-falling opening 71 in the partition 57 to the upstream end of the supply channel 53*a* in the developer conveyance direction therein.

It is to be noted that, although the supply channel 53*a* and the collecting channel 54*a* are illustrated as if they are away from each other in FIG. 6, it is intended for ease of understanding of supply and collection of developer from the developing sleeve 51. The supply channel 53*a* and the collecting channel 54*a* are separated by the planar partition 57 as shown in FIG. 4, and the developer-falling opening 71 and the developer-lifting opening 72 are through holes in the partition 57.

As shown in FIG. 6, developer inside the supply channel 53*a* beneath the collecting channel 54*a* is scooped by the surface of the supply screw 53 while being transported in the longitudinal direction by the supply screw 53. At that time, developer can be scooped by the surface of the developing sleeve 51 by the rotation of the supply screw 53 as well as the magnetic force exerted by the fifth pole P5 (shown in FIG. 4), serving as a developer scooping pole. Then, the developer carried on the developing sleeve 51 passes through the development range, is separated from the developing sleeve 51, and transported to the collecting channel 54*a*. At that time, developer is separated from the surface of the developing sleeve 51 by the magnetic force exerted by a developer release pole constructed of the fourth and fifth magnetic poles P4 and P5 having the same polarity (N) and being adjacent to each other and the separating capability of the partition 57.

In the developing device 5, the fourth and fifth poles P4 and P5 (i.e., the developer release pole) generate a repulsive magnetic force. The developer transported to the area in which the repulsive magnetic force is generated (i.e., a developer release area) is released by the developer release pole in a direction of composite of a normal direction and a direction tangential to the rotation of the developing sleeve 51. Then, the developer falls under the gravity to the partition 57 and is collected by the collecting screw 54.

The collecting screw 54 in the collecting channel 54*a*, which is above the supply channel 53*a*, transports the developer separated from the developing sleeve 51 in the developer release area axially in the direction opposite the direction in which the supply screw 53 transports the developer.

Through the developer-lifting opening 72, the downstream end of the supply channel 53*a* in which the supply screw 53 is provided communicates with the upstream end of the collecting channel 54*a* in which the collecting screw 54 is provided. The developer at the downstream end of the supply channel 53 accumulates there and pushed up by the developer transported from behind. Then, the developer moves through the developer-lifting opening 72 to the upstream end of the collecting channel 54*a*.

The toner supply inlet 59 is in the upstream end portion of the collecting channel 54*a*, and fresh toner is supplied as required by a toner replenishing device from the toner container 11 (shown in FIG. 2) to the developing device 5 through the toner supply inlet 59. The upstream end of the supply channel 53*a* communicates with the downstream end of the collecting channel 54*a* via the developer-falling opening 71. The developer transported to the downstream end of the collecting channel 54*a* falls under its own weight through the developer-falling opening 71 to the upstream end portion of the supply channel 53*a*.

As described above, the supply screw 53 and the collecting screw 54 rotate in the directions shown in FIG. 4, and developer is attracted to the developing sleeve 51 by the magnetic attraction exerted by the magnet roller 55 contained in the developing sleeve 51. Additionally, the developing sleeve 51 is rotated at a predetermined velocity ratio to the velocity of the photoreceptor 1 to scoop up the developer to the development range consecutively.

Next, a lateral end cover of the developing device 5 is described.

Figure 7:
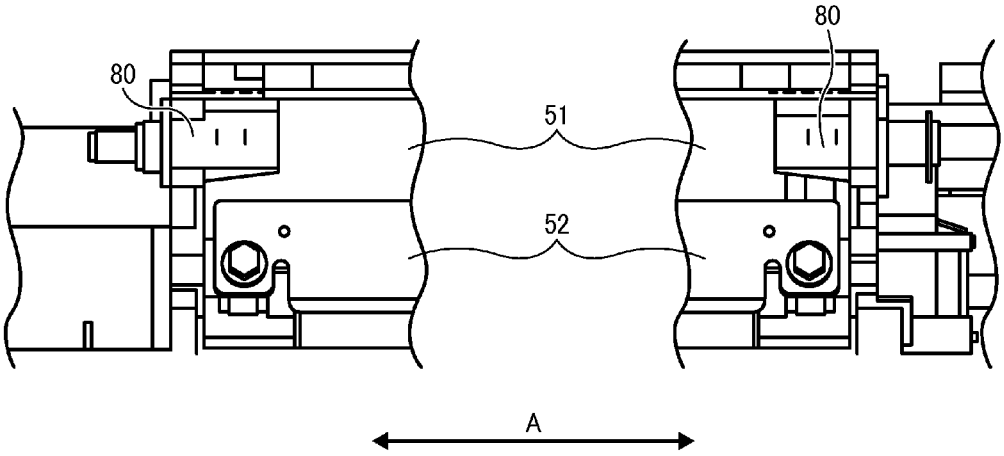
FIG. 7 is a side view of both end portions in the axial direction of the developing device shown in FIG. 4.

FIG. 7 is a side view illustrating both axial end portions of the developing device 5 as viewed from the right in FIG. 4.

In FIG. 7, a front end side of the developing device 5 is on the left, and a rear end side of the developing device 5 is on the right. As shown in FIG. 7, a lateral end seal 80 serving as the lateral end cover is provided to either end portion of the developing sleeve 51 in the axial direction thereof, indicated by arrow A (hereinafter "axial direction A"). It is to be noted that hereinafter the terms "axial inner side", "axial inner periphery", and "axial outer side" are based on inner side (or center side) and the outer side (end side) in the axial direction of the developing sleeve 51 or the developing roller 50. The lateral end seals 80 are flexible sheet members and can be constructed of polyurethane, for example.

Although laterally inverted in shape, the lateral end seals 80 on the front and rear end sides are similar in shape and position. Accordingly, only the lateral end seal 80 on the rear end side (on the right in FIG. 7) is described below, and the descriptions of the lateral end seal 80 on the front end side are omitted.

The lateral end seal 80 is disposed to cover the outer circumference of the developing sleeve 51 between the photoreceptor 1 and the developing sleeve 51 in a range including the first pole P1 in the direction of rotation of the developing sleeve 51, in the axial end portion.

Figure 8:
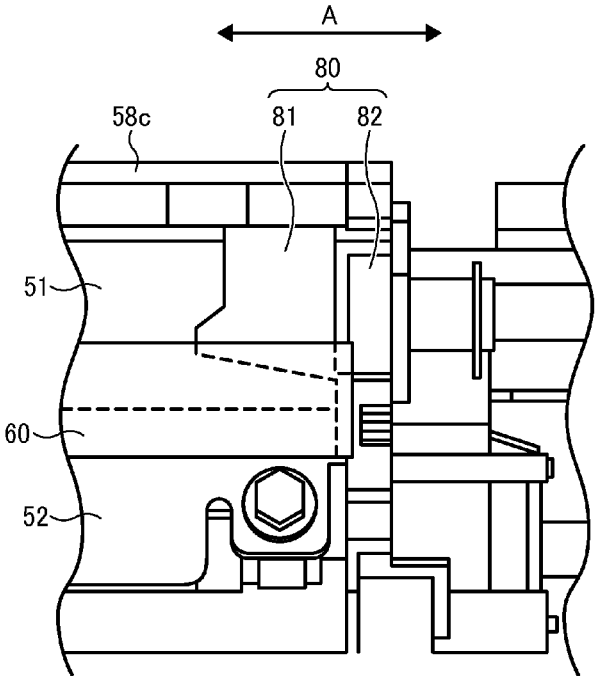
FIG. 8 is a schematic diagram illustrating a rear end side of the developing device shown in FIG. 4 with a lateral end seal.
Figure 9:
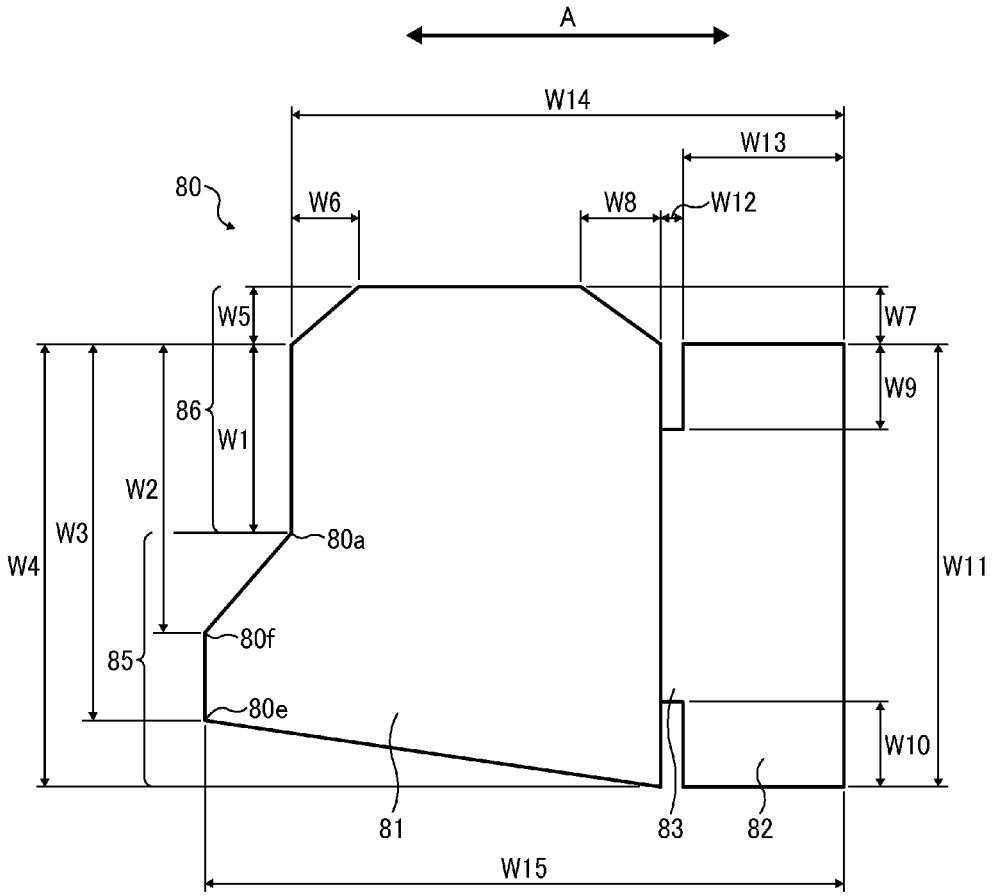
FIG. 9 is an enlarged view of the lateral end seal shown in FIG. 8.

FIG. 8 illustrates a state in which the lateral end seal 80 is attached to the rear end side of the developing device 5 shown in FIG. 4. FIG. 9 is an enlarged view of the lateral end seal 80 on the rear end side.

As shown in FIG. 9, the lateral end seal 80 includes a cover portion 81, an attaching margin 82, and a narrow portion 83. To attach the lateral end seal 80 to the developing device 5, the attaching margin 82 is attached with double-sided adhesive tape to an attaching face 58*d* (shown in FIG. 16) of the casing 58 so that an axial inner periphery of the cover portion 81 covers the axial end portion of the developing sleeve 51 as shown in FIG. 8.

The narrow portion 83 is positioned between the cover portion 81 and the attaching margin 82 in the axial direction A and reduced in length in the direction of rotation of the developing sleeve 51 (vertical direction in FIG. 9) from them. It is preferable that the upper and lower ends of the narrow portion 83 in FIG. 9 be R-shaped at (not perpendicular to) boundaries with the cover portion 81 and the attaching margin 82.

Additionally, as shown in FIG. 8, a development range entrance seal 60 is provided between the regulation position, where the doctor blade 52 faces the developing sleeve 51, and the development range to prevent toner scattering. The development range entrance seal 60 is disposed to cover a lower exposed portion of the developing sleeve 51 as well as a lower portion of the lateral end seal 80.

FIG. 1 is a schematic diagram illustrating the axial end portion of the developing sleeve 51 for understanding of relative positions of the lateral end seal 80 and the developing nip.

In FIG. 1, reference character G1 represents a layer of developer carried on the surface of the developing sleeve 51 (hereinafter "developer layer G1"). The developer layer G1 becomes a magnetic brush on the surface of the developing sleeve 51. A range surrounded by chain double-dashed lines in FIG. 1 represents the developing nip where the magnetic brush contacts the surface of the photoreceptor 1 (hereinafter "developing nip 90"). The developing nip 90 extends into the range covered by the lateral end seal 80 in FIG. 1, and the magnetic brush contacts the photoreceptor 1 in that portion if the lateral end seal 80 is not present. In that portion, the magnetic brush contacts a face of the lateral end seal 80 on the side of the developing sleeve 51.

Further, the length of the developing nip 90 in the direction of rotation of the developing sleeve 51, indicated by arrow C (hereinafter "sleeve rotation direction C"), is referred to as a developing nip width 90W.

In the developing device 5 according to the present embodiment, for example, the developing sleeve 51, inside which the magnet roller 55 is provided, is 20 mm in diameter, and the photoreceptor 1, which faces the developing sleeve 51 in the development range, is 30 mm in diameter. In this configuration, when the development gap, which is the distance between the surface of the developing sleeve 51 and the surface of the photoreceptor 1, is 0.3 mm, the developing nip width 90W is from about 3.0 mm to about 4.0 mm.

As shown in FIG. 1, the lateral end seal 80 covers the axial end portion of the developing nip 90 where the developer layer G1 becomes the magnetic brush and inhibits developer from moving to the surface of the photoreceptor 1.

It is to be noted that, in FIG. 1, reference numeral 91 represents a developing nip centerline that is a virtual line passing through a center of the developing nip 90 in the sleeve rotation direction C and perpendicular to the sleeve rotation direction C. Additionally, in FIG. 1, reference numeral 92 represents a developing nip upstream end line that is a virtual line passing through an upper end of the developing nip 90 in the sleeve rotation direction C and perpendicular to the sleeve rotation direction C. It is to be noted that, the center position and the upstream end of the developing nip 90 in the sleeve rotation direction C may fluctuate depending on the position of the developing nip 90 in the axial position, and the center position and the upstream end used here are based on a center position in the axial direction A of the developing sleeve 51.

As shown in FIG. 4, the density of magnetic flux on the surface of the developing sleeve 51 in the normal direction thereto depends on the magnetic pole arrangement of the magnet roller 55 and varies depending on the position in the sleeve rotation direction C. When the position at which the density of magnetic flux generated by the first pole P1 (north pole) in normal direction is highest is set as a development pole center position, the development pole center position is substantially aligned with the developing nip centerline 91. Additionally, the upstream end of the development range is substantially aligned with the developing nip upstream end line 92.

As shown in FIG. 1, in the lateral end seal 80, an axial inner side between corners 80*a* and 80*b* (hereinafter "axial inner side 80*a*-80*b*") downstream (upper side in FIG. 1) from the developing nip centerline 91 in the sleeve rotation direction C is parallel to the sleeve rotation direction C. The axial inner side 80*a*-80*b* is perpendicular to the developing nip centerline 91, overlaps with the developing nip 90 on the upstream side, and defines the width of a portion contributing to development in the developing nip 90. In the lateral end seal 80, a portion downstream from the corner 80*a* and including the axial inner side 80*a*-80*b* is referred to as a developing nip regulating portion 86.

The lateral end seal 80 further includes a wide seal portion 85 positioned upstream (lower side in FIG. 1) from the developing nip centerline 91 in the sleeve rotation direction C. The wide seal portion 85 is longer in the axial direction A than the developing nip regulating portion 86 positioned downstream from the developing nip centerline 91 in the sleeve rotation direction C. In the present embodiment, the axial inner periphery (a side between corners 80*e* and 80*f*, hereinafter "axial inner side 80*e*-80*f*") of the wide seal portion 85 is shifted by about 1.0 mm to about 5.0 mm from the axial inner periphery (axial inner side 80*a*-80*b*) of the developing nip regulating portion 86 to the axial inner side at a position where the axial inner periphery of the wide seal portion 85 extends most to the axial inner side.

In the lateral end seal 80, the axial inner side 80*a*-80*b*, which is the axial inner periphery of the developing nip regulating portion 86, and an inclined side between the corners 80*a* and 80*f* (hereinafter "inclined side 80*a*-80*f*"), which is the axial inner periphery of the wide seal portion 85, contact the surface of the photoreceptor 1.

A downstream end (the corner 80*a* in FIG. 1) of the wide seal portion 85 in the sleeve rotation direction C is aligned with the developing nip centerline 91 or positioned between the developing nip centerline 91 and the developing nip upstream end line 92. Additionally, the axial inner periphery (the side 80*a*-80*b* in FIG. 1) of the developing nip regulating portion 86 is shaped to follow the sleeve rotation direction C (vertical direction in FIG. 1).

Here, a developing device including a comparative lateral end cover is described below.

There are two-component developing devices that employ a flexible member (i.e., a lateral end cover) constructed of a urethane sheet, plastic such as Mylar® (registered trademark of DuPont), Teflon (registered trademark) felt, or combinations thereof to inhibit scattering of toner or leak of developer occurring at both ends of the developer bearer. Such a lateral end cover is attached to a part of the housing of the developing device to which the developer bearer is attached to cover the axial end portion of the developer bearer.

In two-component developing devices, the axial end portion of the developer bearer is often covered with such a flexible member (i.e., the lateral end cover) to inhibit scattering (or adhesion) of toner and carrier.

For example, such a flexible member covers the axial end portions of the developer bearer contactlessly. Alternatively, the clearance between the latent image bearer and the developer bearer is filled to inhibit leak and scattering (or adhesion) of developer caused by a magnetic field in the axial end portions of the developer bearer. Alternatively, the flexible sheet may be disposed in contact with the latent image bearer and away from the magnet contained in the developer bearer in the axial direction. Further, such a flexible member may be used to cover a portion outside the magnet contained in the developer bearer in the axial direction to inhibit scattering of toner.

In two-component developing devices in which magnetic brushes contact the photoreceptor, the lateral end cover is typically disposed several millimeters away from the end of the developer layer on the developer bearer so that the developer layer is not caught by an axial inner periphery (edge) of the lateral end cover. If the clearance between the end of the developer layer and the lateral end cover is large, however, insufficiently charged toner that is not adsorbed to carrier is discharged from the clearance, resulting in scattering of toner.

In particular, in middle-high speed machines in which scattering of toner is likely to occur, there are cases where the lateral end cover is disposed to overlap with the developer layer on the developer bearer to inhibit scattering of toner in the axial end portion with a smaller number of components and lower cost.

Alternatively, to meet demands for accepting wide sheets and apparatus compactness, there are cases where the lateral end cover is overlapped with the developer layer to reduce the space outside the developing nip in the axial direction.

When the lateral end cover is disposed to overlap with the developer layer to satisfy the demanded specification of image forming apparatuses, this arrangement may increase the possibility of leak of developer from the axial inner periphery of the lateral end cover to the outer side in the axial direction of the developer bearer. If developer leaks from the axial inner periphery of the lateral end cover, it is possible that developer including carrier adheres to the latent image bearer, resulting in adhesion of carrier thereon. Then, there is a risk of damage to peripheral units and components including the latent image bearer.

The occurrence of toner scattering and carrier adhesion described above may be inhibited by interposing a seal member in which a polyurethane seal and an elastic member such as Moltopren (registered trademark) are combined between the developer bearer and the latent image bearer in the axial end portion so that the clearance therebetween is sealed while compressing the elastic member. However, it is possible that toner adheres to the surface of the developer bearer and the seal member hardens with progress of the adhesion, thus causing increases in torque and leak of developer. As a result, the operational life of the unit can be reduced significantly.

Next, descriptions are given below of a configuration in which toner scatters and a configuration in which carrier adhesion arises.

Figure 10:
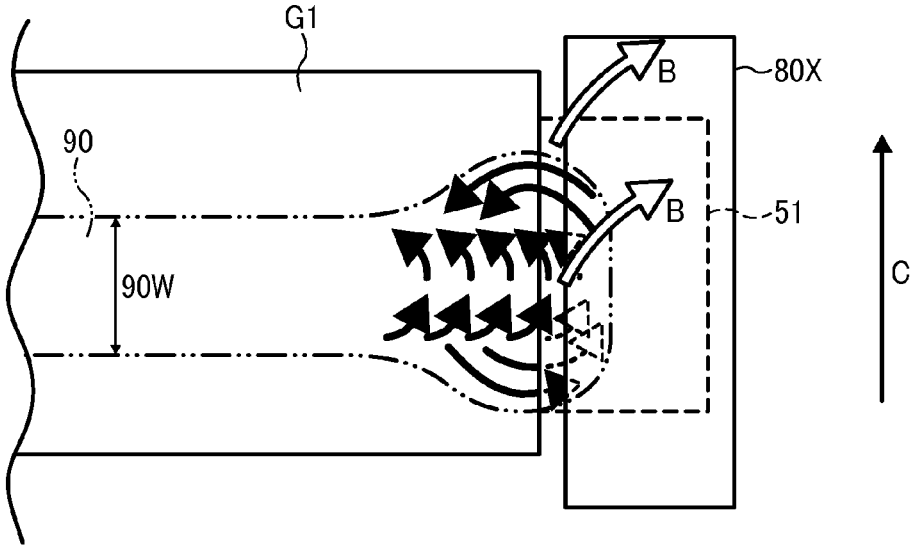
FIG. 10 is a schematic diagram of an outer end portion in an axial direction of a developing sleeve according to a comparative example.

FIG. 10 is a schematic diagram illustrating a portion adjacent to the axial end of the developing sleeve 51 in the configuration in which toner scatters for understanding of relative positions of a comparative lateral end seal 80X and the developing nip 90.

In FIG. 10, the developing nip 90 is enclosed by chain double-dashed lines, and the developing nip width 90W is the length thereof in the sleeve rotation direction C.

Similar to the configuration shown in FIG. 1, in the configuration shown in FIG. 10, the developing sleeve 51 is 20 mm in diameter, and the photoreceptor 1 is 30 mm in diameter. The development gap is 0.3 mm, and the developing nip width 90W is from about 3.0 mm to about 4.0 mm.

In an area adjacent to the axial end of the developing nip 90, the magnetic brush follows the going-around magnetic field generated at the end of the magnet roller 55 inside the developing sleeve 51. Additionally, an end of the magnetic brush following the going-around magnetic field spirals (or moves in vortexes) as indicated by black solid arrows in FIG. 10 as the surface of the developing sleeve 51 moves upward in FIG. 10 (in the sleeve rotation direction C). Due to the spiraling end of the magnetic brush adjacent to the axial end, the developing nip 90 bulges more adjacent to the axial end than in an axial center portion as shown in FIG. 10.

In the comparative developing device shown in FIG. 10, the lateral end seal 80X is positioned about 2.0 mm to 4.0 mm away from the developer layer G1. Accordingly, even when the end of the magnetic brush spirals, developer rarely enters the clearance between the lateral end seal 80X and the photoreceptor 1. However, adjacent to the axial end of the developing nip 90, the surface of the developing sleeve 51 is exposed in a portion where the magnetic brush is not present or the shape of the magnetic brush is not stable, and accordingly toner can scatter from that portion as indicated by arrow B in FIG. 10.

Figure 11A:
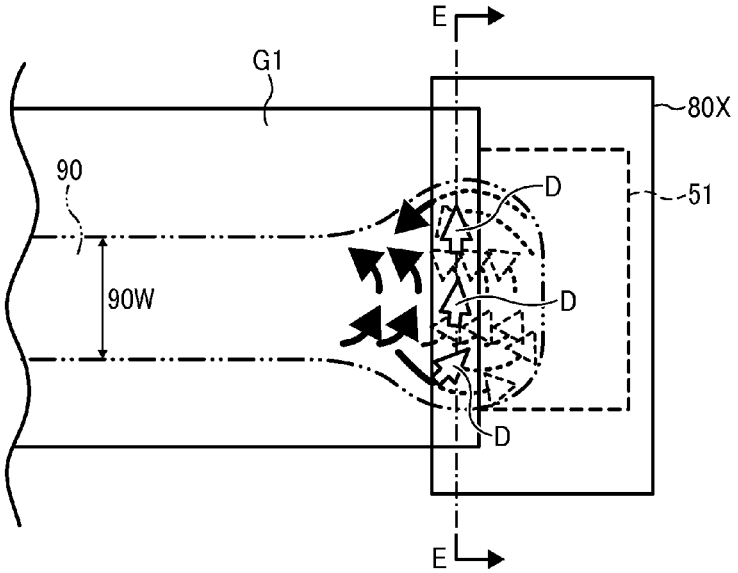
FIG. 11A is a view of an axial end portion of a developing sleeve, as viewed from the photoreceptor in a configuration in which carrier adhesion arises.
Figure 11B:
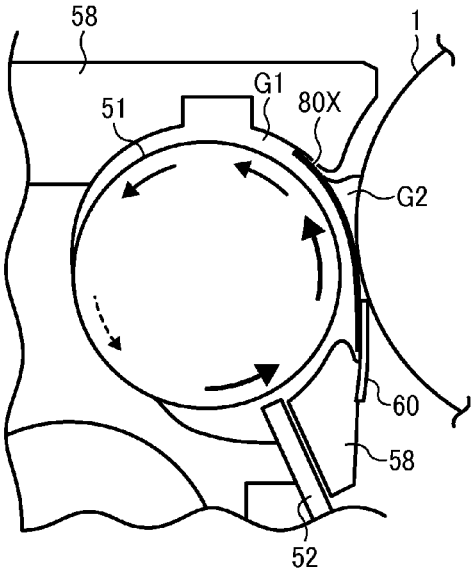
FIG. 11B illustrates a cross section along line E-E shown in FIG. 11A.
Figure 11C:
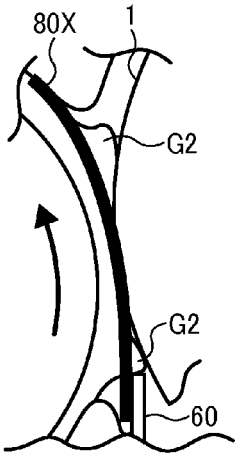
FIG. 11C is an enlarged view of the adjacent portion of the development range in FIG. 11B.

FIGS. 11A, 11B, and 11C are schematic diagrams illustrating a portion adjacent to the axial end of the developing sleeve 51 in the configuration in which carrier adhesion arises for understanding of relative positions of the comparative lateral end seal 80X and the developing nip 90. FIG. 11A is a view of the axial end portion as viewed from the photoreceptor 1, FIG. 11B illustrates a cross section along line E-E shown in FIG. 11A, and FIG. 11C is an enlarged view of the adjacent portion of the development range in FIG. 11B.

In FIG. 11A, out of the flow of the spiraling end of the magnetic brush, a portion covered with the lateral end seal 80X is indicated by broken arrow.

As shown in FIG. 11A, the relative positions of the magnet roller 55 (shown in FIG. 4) and the lateral end seal 80X are set such that the lateral end seal 80X covers the axial end portion of the developer layer G1.

In the state in which developer is transported to the axial inner periphery of the lateral end seal 80X, as shown in FIG. 11A, clearance that is a start point of toner scattering is eliminated. Accordingly, toner scattering from the axial end portion of the developing sleeve 51 can be inhibited, thus reducing the amount of scattering toner.

However, as indicated by arrow D shown in FIG. 11A, developer protrudes from the developer layer G1 bulging due to the going-around magnetic field toward the photoreceptor 1 (to the front side of the paper on which FIG. 11A is drawn).

In FIGS. 11B and 11C, reference character G2 represents the protruding developer, and the protruding developer G2 is interposed between the lateral end seal 80X and the photoreceptor 1.

Although carrier included in the protruding developer G2 is retained by the magnetic force exerted by the magnet roller 55, the lateral end seal 80X breaks chains of the magnetic brush, and magnetic restrain that retains the carrier in the protruding developer G2 weakens. As a result, carrier adheres (or scatters) to the photoreceptor 1 adjacent to the lateral end seal 80X. FIGS. 11A and 11C illustrate the progress of protruding of developer (G2) from the developer layer G1.

When carrier adhesion occurs, the cleaning blade 2*a* that cleans the photoreceptor 1 may be damaged, and the damaged portion causes streaky stains. Additionally, if carrier adhesion occurs adjacent to the axial end of the photoreceptor 1, carrier may enter between the photoreceptor 1 and a charging gap roller 4*b* (shown in FIG. 17), which secures a charging gap between the photoreceptor 1 and the charging roller 4*a*. If carrier enters between the charging gap roller 4*b* and the photoreceptor 1, a surface layer of the photoreceptor 1 may be peeled off, or the charging gap may fluctuates. Although such inconveniences may be solved by disposing the charging gap roller 4*b* on the outer side in the axial direction, such arrangement increases the axial size of the charging device 40 and the image forming unit 6.

Figure 12A:
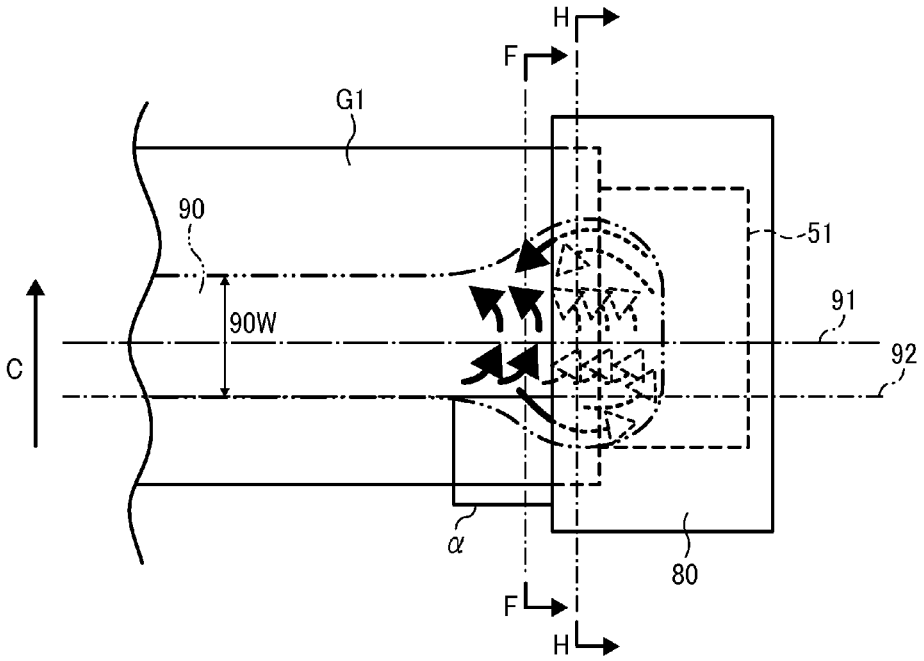
FIG. 12A is a schematic view of the axial end portion of the developing sleeve as viewed from the photoreceptor, for understanding of a concept of inhibiting developer from protruding while inhibiting toner scattering.
Figure 12B:
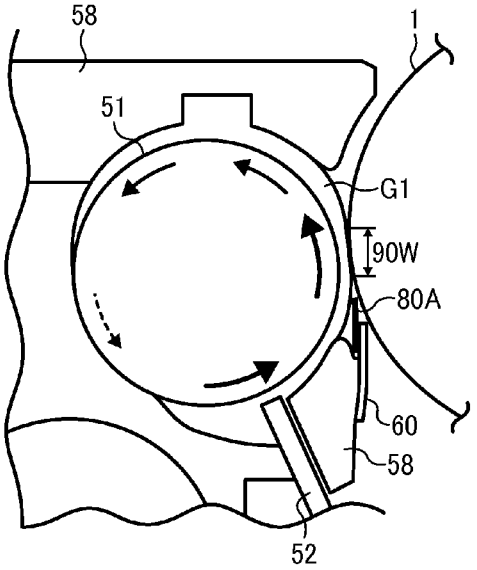
FIG. 12B is a cross-sectional view along line F-F shown in FIG. 12A.
Figure 12C:
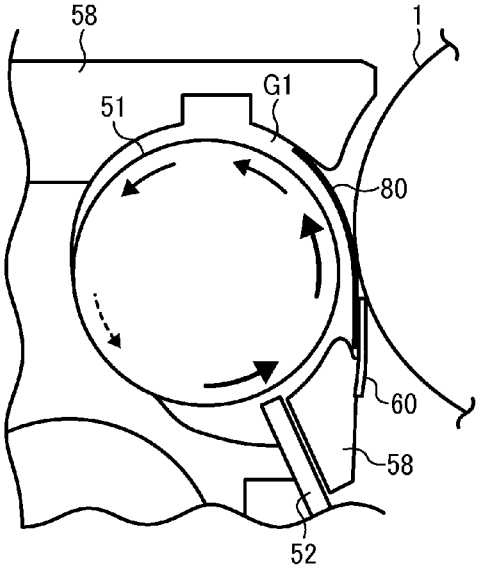
FIG. 12C is a cross-sectional view along line H-H shown in FIG. 12A.

Referring to FIGS. 12A, 12B, and 12C, descriptions are given below of inhibiting developer from protruding while inhibiting toner scattering. FIG. 12A is a schematic view of the axial end portion of the developing sleeve 51 as viewed from the photoreceptor 1. FIG. 12B is a cross-sectional view along line F-F shown in FIG. 12A, and FIG. 12C is a cross-sectional view along line H-H shown in FIG. 12A.

In FIG. 12A, reference character a represents a range upstream from the developing nip centerline 91 in the sleeve rotation direction C and extending 1.0 mm to 5.0 mm to the axial center side from the inner periphery of the comparative lateral end seal 80X shown in FIG. 11A. As shown in FIG. 12A, the range α is pressed down by, for example, a sheet member. The range α is the start point of the flow of developer (G2) protruding to the photoreceptor 1 as indicated by arrow D in FIG. 11A. By covering the range α that is the start point, developer can be inhibited from protruding to the axial end side, and, as shown in FIGS. 12B and 12C, developer can be inhibited from entering between the lateral end seal 80 and the photoreceptor 1.

As shown in FIG. 1, the lateral end seal 80 provided to the developing device 5 according to the present embodiment includes the wide seal portion 85 that covers a range equivalent to the range α shown in FIG. 12A. With this configuration, the start point of the flow of developer protruding to the photoreceptor 1 can be pressed down, and developer can be inhibited from entering between the lateral end seal 80 and the photoreceptor 1. Thus, carrier adhesion can be suppressed. Additionally, since the axial inner periphery of the lateral end seal 80 covers the axial end portion of the developer layer G1, clearance that is the start point of toner scattering can be eliminated, thereby inhibiting toner scattering from the axial end portion.

Figure 13A:
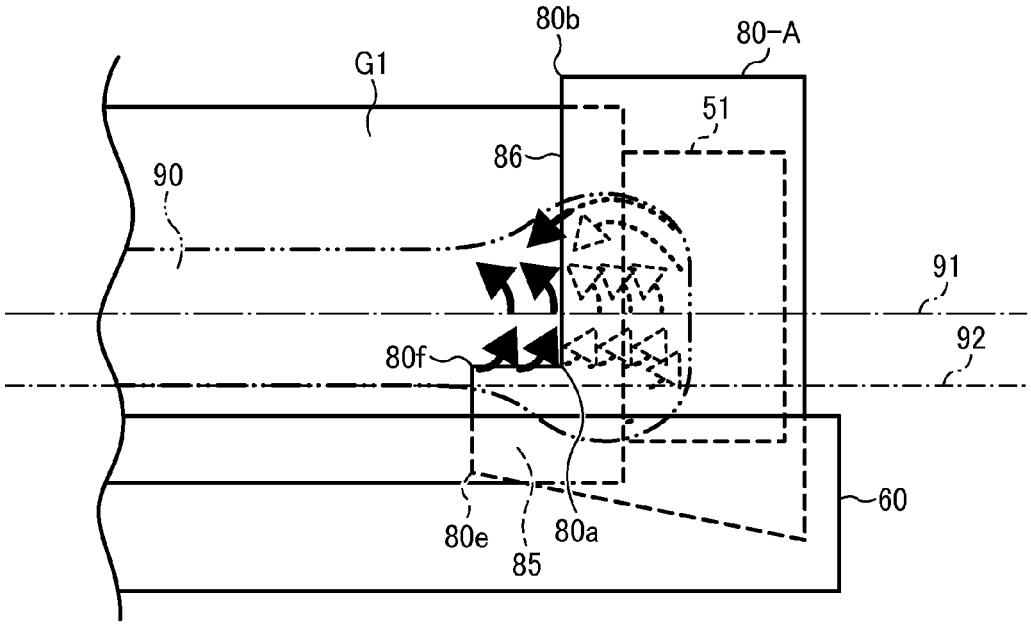
FIG. 13A is a schematic diagram of an axial end portion of a developing sleeve in a variation, as viewed from the side of the photoreceptor.
Figure 13B:
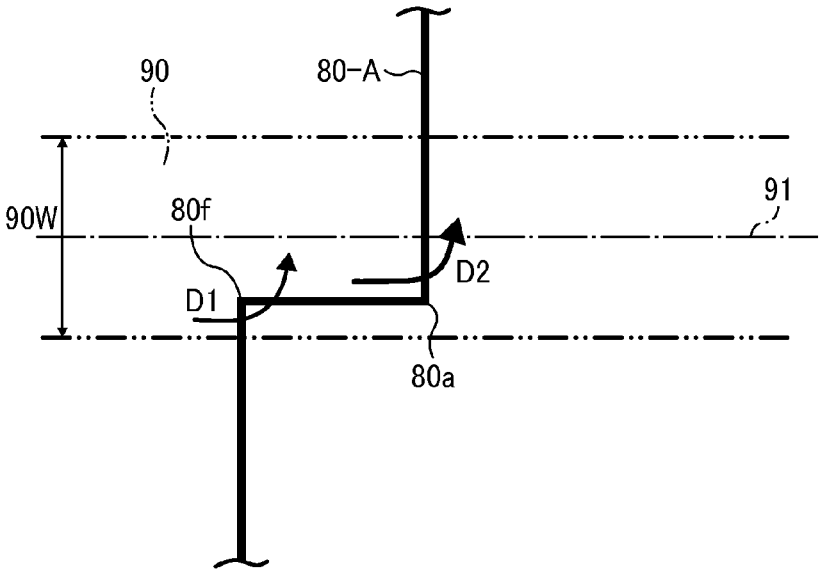
FIG. 13B is an enlarged view of an area adjacent to an axial inner periphery of a lateral end seal according to the variation.

Referring to FIGS. 13A and 13B, relative positions of the developing nip 90 and a lateral end seal 80-A according to a variation are described below. FIG. 13A is a schematic diagram illustrating the axial end portion of the developing sleeve 51 in the variation, as viewed from the side of the photoreceptor 1, and FIG. 13B is an enlarged view of an area adjacent to an axial inner periphery of the lateral end seal 80-A.

Figure 14A:
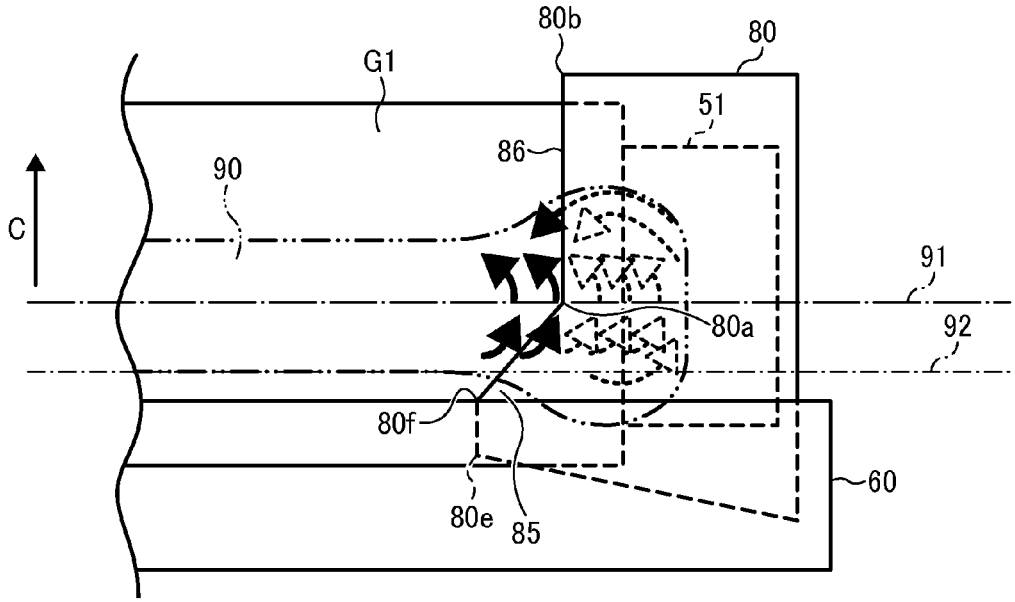
FIG. 14A is a schematic view of the axial end portion of the developing sleeve, as viewed from the side of the photoreceptor, for understanding of relative positions of the developing nip and the lateral end seal shown in FIG. 1.
Figure 14B:
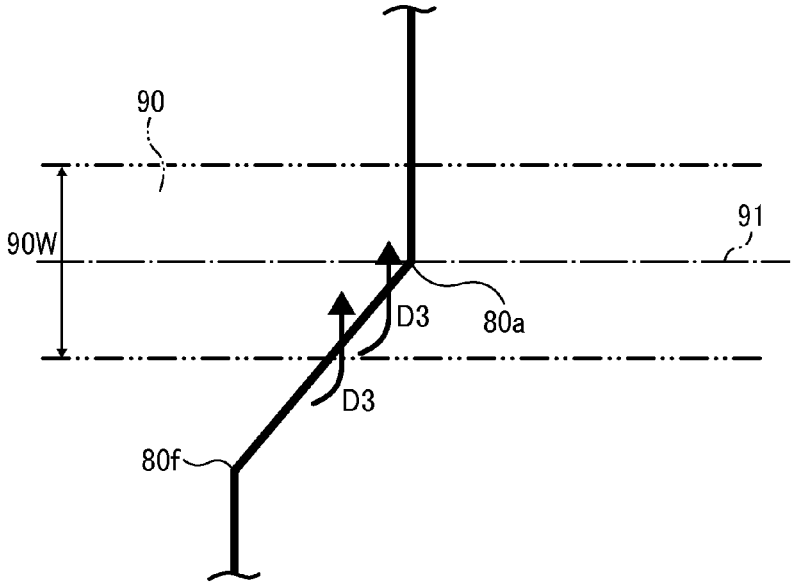
FIG. 14B is an enlarged view of an area adjacent to the axial inner periphery of the lateral end seal shown in FIG. 1.

FIG. 14A is a schematic view of the axial end portion of the developing sleeve 51, as viewed from the side of the photoreceptor 1, for understanding of relative positions of the developing nip 90 and the axial inner periphery of the lateral end seal 80 shown in FIG. 1. FIG. 14B is an enlarged view of an area adjacent to the axial inner periphery of the lateral end seal 80 shown in FIG. 1.

As shown in FIGS. 14A and 14B, the wide seal portion 85 of the lateral end seal 80 shown in FIG. 1 has the inclined side 80*a*-80*f* oblique to the developing nip centerline 91 so that the axial length (i.e., width) thereof continuously increases from the downstream end (the corner 80*a*) to the upstream side in the sleeve rotation direction C.

By contrast, as shown in FIGS. 13A and 13B, in the lateral end seal 80-A according to the variation, the side 80*a*-80*f* starting from the downstream end (the corner 80*a*) of the wide seal portion 85 in the sleeve rotation direction C is parallel to the developing nip centerline 91.

It is to be noted that the respective sides of the lateral end seal 80 are lines cut while the shape shown in FIG. 9 is produced from a sheet member, and the respective sides are panes having a certain thickness.

In the variation shown in FIGS. 13A and 13B as well, the wide seal portion 85 of the lateral end seal 80-A covers a part of the range α shown in FIG. 12A. Accordingly, compared with the comparative example shown in FIGS. 11A through 11C, developer can be inhibited from entering between the lateral end seal 80-A and the photoreceptor 1, and carrier adhesion can be suppressed.

Additionally, since the corner 80/(a corner of the wide seal portion 85) is inside the developing nip 90, it is conceivable that developer protrudes beyond the axial inner side 80*e*-80/to the axial outer side. At that time, developer moves along the movement of the magnetic brush. Accordingly, as indicated by arrows D1 and D2 shown in FIG. 13B, the protruding developer can easily reach the portion not covered with the lateral end seal 80A, and it is not difficult for the developer to get out from between the lateral end seal 80-A and the photoreceptor 1.

In the variation, however, the downstream end (the corner 80*a*) of the wide seal portion 85 in the sleeve rotation direction C is positioned downstream from the developing nip centerline 91 in the sleeve rotation direction C. Additionally, the axial inner side 80*a*-80*b* of the developing nip regulating portion 86 is partly upstream from the developing nip centerline 91 in the sleeve rotation direction C. Therefore, it is not easy for the protruding developer (indicated by arrow D shown in FIG. 13B) to reach the portion not covered with the lateral end seal 80A, and developer interposed between the lateral end seal 80-A and the photoreceptor 1 may result in carrier adhesion.

Additionally, since the corner 80*f*, which is at right angle, is inside the developing nip 90, the position of the corner 80*f* is likely changed by the contact with the magnetic brush. Then, there is a risk that the contact state of the lateral end seal 80-A with the developer layer G1 fluctuates due to the change in position of the corner 80*f*. Fluctuations in the contact state can cause the developing nip width 90W to fluctuate or degrade the capability of inhibiting toner scattering.

The occurrence of carrier adhesion in the variation can be alleviated by disposing the downstream end (the corner 80*a*) of the wide seal portion 85 in the sleeve rotation direction C on the developing nip centerline 91. In this case, however, the corner 80*f* is aligned with the developing nip centerline 91, and unfortunately, the possibility of fluctuations in position of the corner 80*f* caused by the contact with the magnetic brush is higher than the state shown in FIGS. 13A and 13B.

By contrast, in the lateral end seal 80 according to the embodiment shown in FIG. 1, among the sides defining the wide seal portion 85, the side (i.e., the inclined side 80*a*-80*f*) positioned inside the developing nip 90 is inclined. It is conceivable that developer protrudes to the axial end side beyond the inclined side 80*a*-80*f* that is inside the developing nip 90. At that time, since developer moves along the movement of the magnetic brush, as indicated by arrow D3 shown in FIG. 14B, the protruding developer moves along the magnetic brush and returns to the magnetic brush due to the magnetic field (a suction magnetic field) generated downstream from the position where the developer protrudes. With this action, the developer once protrudes can easily reach the portion not covered with the lateral end seal 80 and easily get out from between the lateral end seal 80 and the photoreceptor 1.

Additionally, since the corner 80*f* of the lateral end seal 80 shown in FIGS. 1 and 9 is obtuse, fluctuations in the position of the corner 80*f* can be inhibited better than the variation in which the corner 80*f* is at right angle. Additionally, since the corner 80*f* is outside the developing nip 90, the position of the corner 80*f* is less likely changed by the contact with the magnetic brush. Additionally, since the corner 80*f* is outside and upstream from the developing nip 90 in the sleeve rotation direction C, the axial inner side 80*e*-80*f* extending from the corner 80*f* upstream in the sleeve rotation direction C and parallel to the sleeve rotation direction C does not overlap the developing nip 90. With this arrangement, developer can be inhibited from protruding from the axial inner side 80*e*-80*f* positioned on the axial inner side and parallel to the sleeve rotation direction C among the sides defining the wide seal portion 85. Thus, the developer can be inhibited from entering between the photoreceptor 1 and the lateral end seal 80.

Additionally, although the axial end portion of the developing nip 90 is reduced in length in the sleeve rotation direction C by providing the wide seal portion 85, the developing nip 90 bulges more adjacent to the axial ends than the axial center portion thereof as described above. Accordingly, a certain amount of nip width (i.e., length in the sleeve rotation direction C) can be secured.

Figure 15:
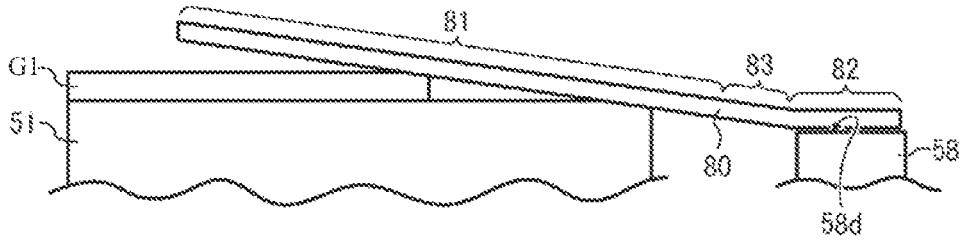
FIG. 15 is a schematic view of the developing sleeve and the lateral end seal shown in FIG. 1, in the portion where the developing nip is present, as viewed from below in FIG. 1.

FIG. 15 is a schematic view of the developing sleeve 51 and the lateral end seal 80 in the portion where the developing nip 90 is present, as viewed from below in FIG. 1. The photoreceptor 1 is positioned on the upper side in FIG. 15.

As shown in FIG. 15, the lateral end seal 80 is attached to the casing 58 of the developing device 5. Additionally, in the direction normal to the surface of the developing sleeve 51 where the developing nip 90 is present, the surface of the developing sleeve 51 is closer to the photoreceptor 1 than the attaching face 58*d* of the casing 58, to which the attaching margin 82 is attached.

As shown in FIG. 1, a side between the corners 80*d* and 80*e* (hereinafter "side 80*d*-80*e*"), which is the upstream end of the lateral end seal 80 in the sleeve rotation direction C, is cut oblique to the adjacent development range entrance seal 60. Additionally, as shown in FIG. 15, the distance from the photoreceptor 1 to the attaching face 58*d* of the casing 58, to which the lateral end seal 80 is attached, is equal to or greater than the distance from the photoreceptor 1 to the surface of the developing sleeve 51. With this arrangement, the lateral end seal 80 is inclined by the developing sleeve 51 and the developer layer G1 so that a free end (opposite the attaching margin 82) approaches the photoreceptor 1. With this inclination, the side 80*d*-80*e* at the upstream end in the sleeve rotation direction C can substantially follow and contact the face of the development range entrance seal 60 on the side of the developing sleeve 51. With this configuration, the lateral end seal 80 can be attached to the casing 58 with the inclined side 80*a*-80*f* constantly abutting on the photoreceptor 1, thus further inhibiting developer from entering between the lateral end seal 80 and the photoreceptor 1.

Differently from the configuration shown in FIG. 15, if, in the direction normal to the surface of the developing sleeve 51 where the developing nip 90 is present, the attaching face 58*d* is closer to the photoreceptor 1 than the surface of the developing sleeve 51, the following inconvenience may occur. When the lateral end seal 80 contacts the surface of the developing sleeve 51, the axial inner periphery of the lateral end seal 80 does not contact the photoreceptor 1. If the axial inner periphery of the lateral end seal 80 is contactless, the position thereof is unstable. When the position of the axial inner periphery is unstable, it is possible that the lateral end seal 80 is creased, and the capability to inhibit carrier adhesion is degraded.

By contrast, as shown in FIG. 15, when the surface of the developing sleeve 51 is closer to the photoreceptor 1 than the attaching face 58*d*, the axial inner periphery of the lateral end seal 80 can contact the surface of the photoreceptor 1, and thus the posture of the lateral end seal 80 can be stable. Then, the occurrence of carrier adhesion can be inhibited effectively.

The shape of the lateral end seal 80 and the position at which the lateral end seal 80 is attached are as shown in FIGS. 1, 8, and 9. The above-described shape and attached state of the lateral end seal 80 can obviate the necessity of using multiple lateral end covers and secure prevention of protruding of developer with a lower contact pressure, thereby inhibiting both of carrier adhesion and toner scattering occurring at the axial end.

It is to be noted that various aspects of the present specification are applicable not only to the developing device 5 shown in FIG. 4, in which the supply channel 53*a* and the collecting channel 54*a* are partitioned from each other, but also any developing device in which the magnetic brush is generated on the developer bearer for image development.

Using the developing device 5 according to the above-described embodiment, the image forming apparatus 500 can be kept compact by inhibiting increases in the axial size. Additionally, toner scattering and carrier adhesion can be inhibited by changing the shape of the lateral end seal 80, in particular, providing the wide seal portion 85, which is simple. Accordingly, the cost of the developing device 5 and the image forming apparatus 500 can be reduced. Further, inhibition of toner scattering and carrier adhesion leads to inhibition of damage to the photoreceptor 1 and peripheral components resulting therefrom, thereby extending the operational lives of the photoreceptor 1, the image forming unit 6, and the image forming apparatus 500.

Example dimensions of length W1 through W15 of the lateral end seal 80, shown in FIG. 9, are listed below.

W1: 6.5 mm, tolerance±0.3 mm,
W2: 9.8 mm, tolerance±0.3 mm,
W3: 12.8 mm, tolerance±0.3 mm,
W4: 15.0 mm, tolerance±0.3 mm,
W5 through W8: 2.0 mm,
W9: 2.5 mm, tolerance±0.3 mm
W10: 2.5 mm, tolerance±0.3 mm
W11: 15.0 mm, tolerance-0.5 mm
W12: 1.0 mm, tolerance±0.2 mm
W13: 5.5 mm, tolerance-0.5 mm
W14: 19.0 mm, tolerance-0.3 mm
W15: 22.0 mm, tolerance±0.3 mm The face of the lateral end seal 80 on the front side of the paper on which FIG. 9 is drawn is opposed to the photoreceptor 1. When the lateral end seal 80 is produced from a rolled sheet, the outer side of the roll is used as the face opposed to the photoreceptor 1. Additionally, double-sided adhesive tape is applied to the face of the attaching margin 82 opposite the photoreceptor 1 not to protrude from the attaching margin 82. Additionally, for example, the lateral end seal 80 has a thickness of 0.1 mm, and a hardness of 92±5 (Hs, according to JIS K7311).

For example, as the material of the lateral end seal 80, KM90, natural color, from Tsuchiya TSCO Co., Ltd. can be used. The double-sided adhesive tape may be 8616CH from DIC corporation.

Descriptions are given below of positioning of the lateral end seal 80 relative to the casing 58 of the developing device 5.

Figure 16:
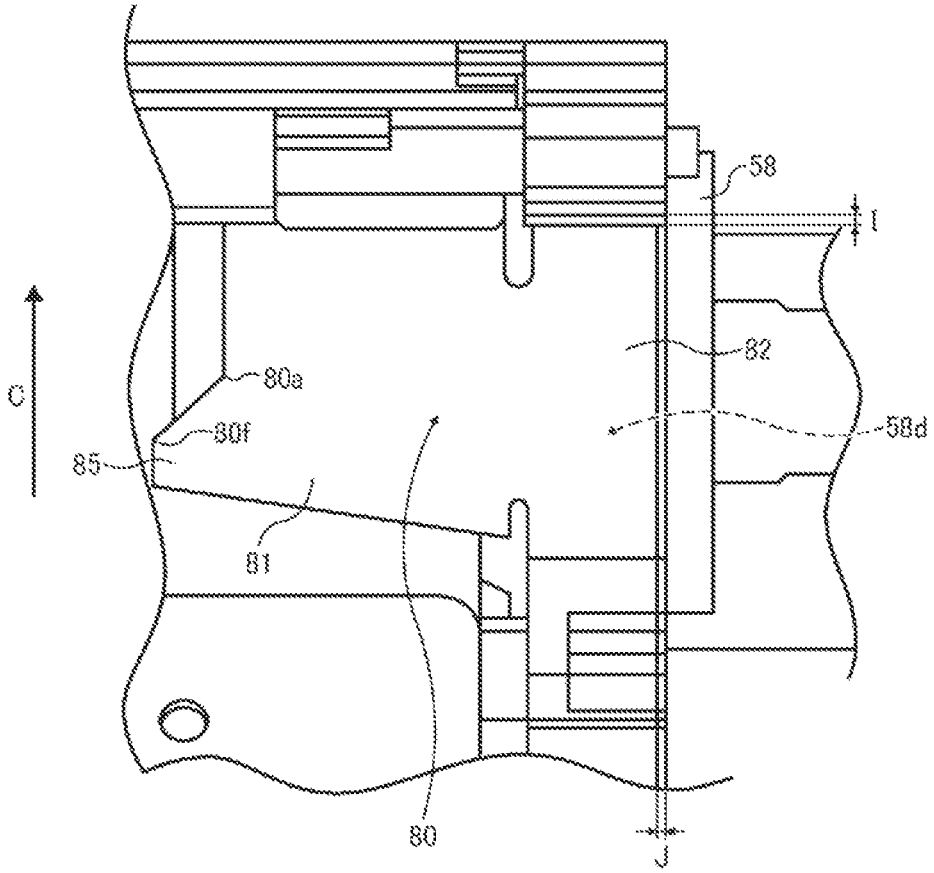
FIG. 16 is a diagram for understanding of the position of the lateral end seal attached to the rear end side of the developing device shown in FIG. 4.

FIG. 16 is a diagram for understanding of the position of the lateral end seal 80 attached to the rear end side of the developing device 5.

In the case of the lateral end seal 80 having inclination as shown in FIGS. 1, 14A, and 14B or having the right-angled corner 80*f* as shown in FIGS. 13A and 13B, when the position where the lateral end seal 80 is attached deviates, it affects the capability to inhibit carrier adhesion. In the developing device 5, as shown in FIG. 16, a reference plane is set at the attaching face 58*d* to which the lateral end seal 80 is attached via double-sided adhesive tape. Then, the lateral end seal 80 is attached so that a tolerance I in the vertical direction and a tolerance J in the axial direction relative to the reference plane fall within a range from 0 to 0.5 mm. With this configuration, the lateral end seal 80 is disposed such that the corner 80*a*, which is a point of intersection of the inclined side 80*a*-80*f* and the axial inner side 80*a*-80*b* parallel to the sleeve rotation direction C, is on the developing nip centerline 91.

The developing sleeve 51 and the magnet roller 55 are supported by the casing 58 of the developing device 5. By positioning the lateral end seal 80 properly relative to the casing 58 supporting the developing sleeve 51 and the magnet roller 55, the lateral end seal 80 can be positioned properly relative to the developing sleeve 51 and the magnet roller 55.

Figure 17:
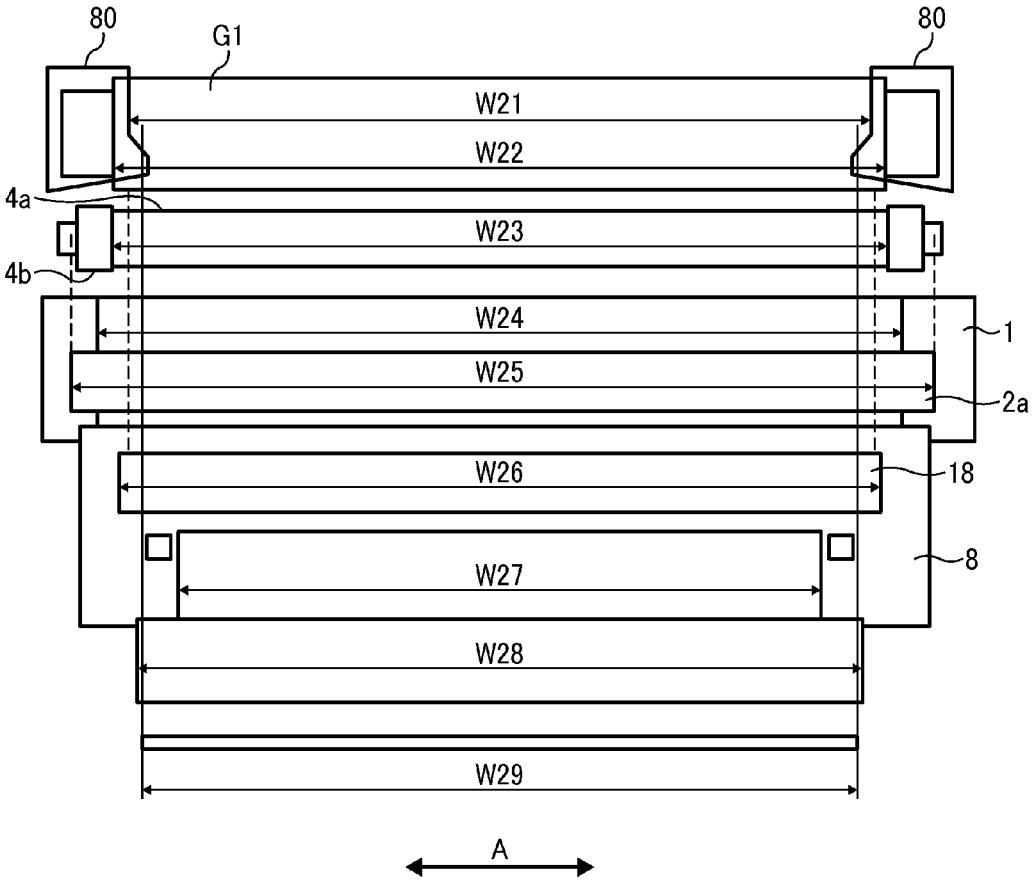
FIG. 17 is a diagram illustrating example dimensions in the axial direction of components of the image forming apparatus shown in FIG. 2.

FIG. 17 is a diagram illustrating example dimensions of components of the image forming apparatus 500 in the axial direction (i.e., widths between the front end side and the rear end side of the device).

A development opening width W21, which is a distance between the axial inner sides 80*a*-80*b* of the lateral end seals 80 at both axial ends, is 334 mm, for example. The axial inner side 80*a*-80*b* is the axial inner periphery of the developing nip regulating portion 86.

A length W22 means a longitudinal length of a portion that contacts the photoreceptor 1 and becomes the developing nip 90 in a state in which the lateral end seal 80 is not provided. The longitudinal length W22 is 338 mm, for example.

A charging roller width W23 is 338 mm, and an effective charging width W24 in the photoreceptor 1 is 342 mm, for example. A cleaning blade width W25 is a length in the axial direction of the cleaning blade 2*a* to clean the photoreceptor 1. The photoreceptor cleaning blade width W25 is 354 mm, for example.

A cleaning blade width W26 is a length in the axial direction of the belt cleaning blade 18 of the belt cleaning unit and is 336 mm, for example.

Additionally, reference character W27 represents a width of A4 sheets placed sideways (i.e., A4 sideways width W27). While the A4 sideways width W27 is 297 mm, a largest sheet width W28 acceptable by the image forming apparatus 500 is 330 mm, and a maximum guaranteed writing width W29 is 327 mm.

Figure 18:
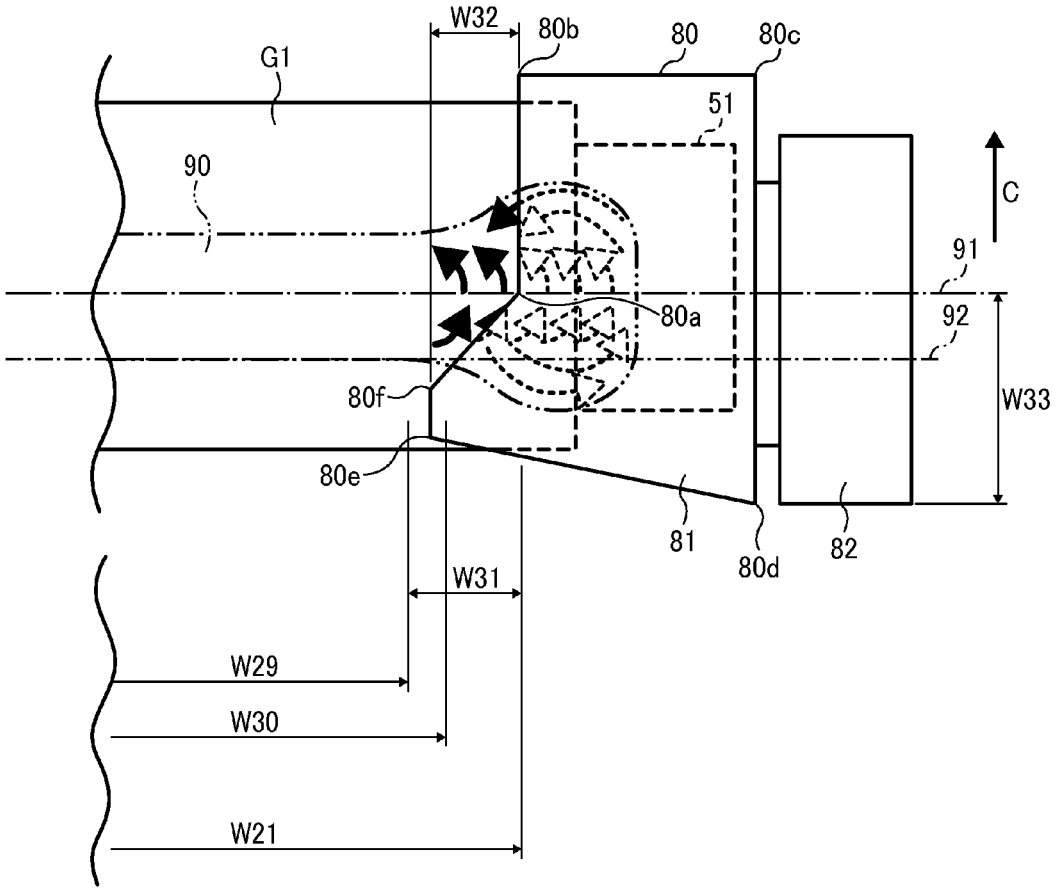
FIG. 18 is a diagram for understanding of example dimensions of the lateral end seal attached to the rear end side of the developing device shown in FIG. 4.

FIG. 18 a diagram for understanding of example dimensions of the lateral end seal 80 attached to the rear end side of the developing device 5. It is to be noted that, in FIG. 18, the development range entrance seal 60 is omitted for simplicity.

The maximum guaranteed writing width W29 is set to 327 mm as the sum of a length of 325 mm required for process control and margins of 1.0 mm on the front side and the rear side of the apparatus (at both axial ends). This is a guaranteed image width for all images including solid images.

A developing roller surface-treated width W30, which is the axial length of a surface-treated portion of the developing sleeve 51, is 329 mm, for example.

The development opening width W21 is set to 334 mm as the sum of the developing roller surface-treated width W30, which is 329 mm, and margins of 2.5 mm on the front side and the rear side of the apparatus.

In the developing device 5 according to the present embodiment, development is feasible up to the development opening width W21, but this is not a guaranteed range for solid images. This is a largest width of images whose density can be secured by edge effects such as line images using trim marks and letters. The developing nip width 90W decreases downstream from a position where the surface of the developing sleeve 51 faces the wide seal portion 85 in the sleeve rotation direction C, and thus the development efficiency is degraded. A necessary developability, however, can be attained by using the axial end portion inside the development opening width W21 as a range for forming images, such as line images and letters, that are supplemented by edge effects and less affected by the decrease in development efficiency.

As shown in FIG. 18, the range of the maximum guaranteed writing width W29 is shifted by a width W31 to the axial center side from the range of the development opening width W21. For example, the width W31 is 3.5 mm in the present embodiment.

Additionally, in the present embodiment, a width 32, which is the difference between the largest axial length of the wide seal portion 85 and the axial length of the developing nip regulating portion 86, is 3.0 mm for example.

A width W33, which is the distance from the corner 80*d* at the upstream end of the lateral end seal 80 to the developing nip centerline 91 in the sleeve rotation direction C, is 8.0 mm, for example.

Experiment

Next, descriptions are given below of an experiment to compare the occurrence of carrier adhesion in the developing device 5 provided with the lateral end seal 80 including the wide seal portion 85 and that in a comparative developing device provided with the lateral end seal 80X without the wide seal portion 85.

Figure 19:
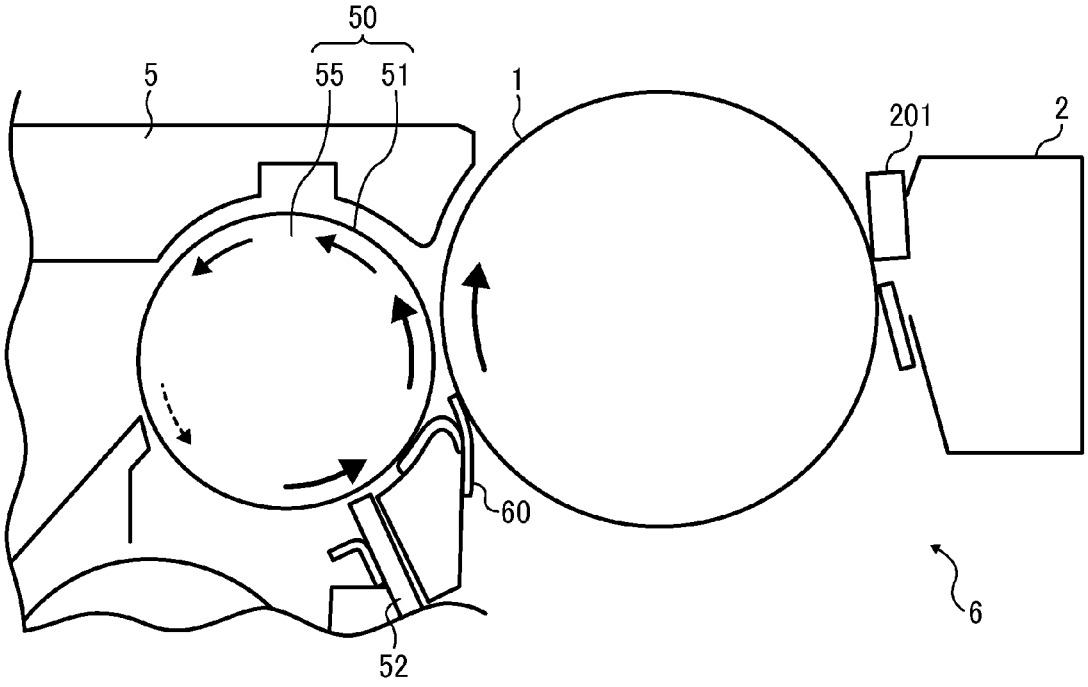
FIG. 19 is a schematic diagram of an image forming unit used in an experiment.

FIG. 19 is a schematic diagram of the image forming unit 6 used in the experiment. In the image forming unit 6 used in the experiment, a collecting pad 201 is provided to the cleaning unit 2. Then, A3 size images were formed on 20 sheets under the combination of developer, the amount of developer scooped, and potentials that were disadvantageous limit against carrier adhesion, and the number of carrier adhesion was checked with a magnifying glass.

Figure 20A:
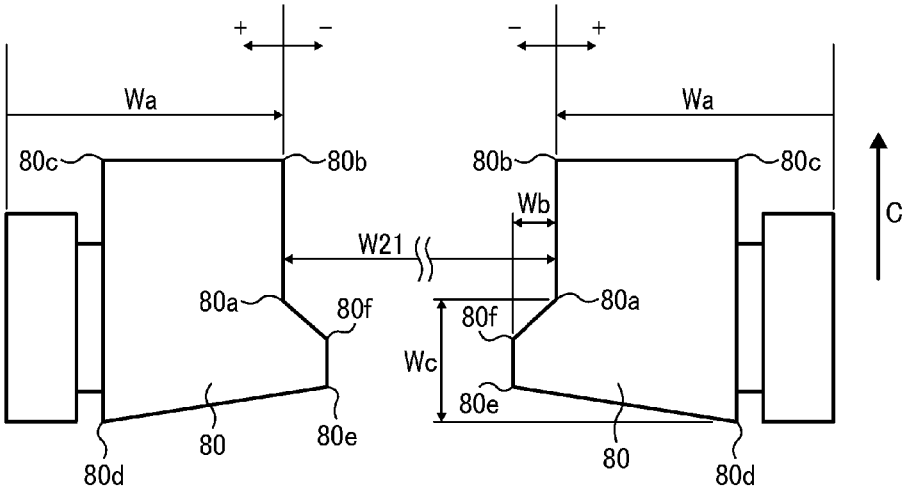
FIG. 20A is a diagram illustrating dimensions of a lateral end seal of a developing device used in the experiment.
Figure 20B:
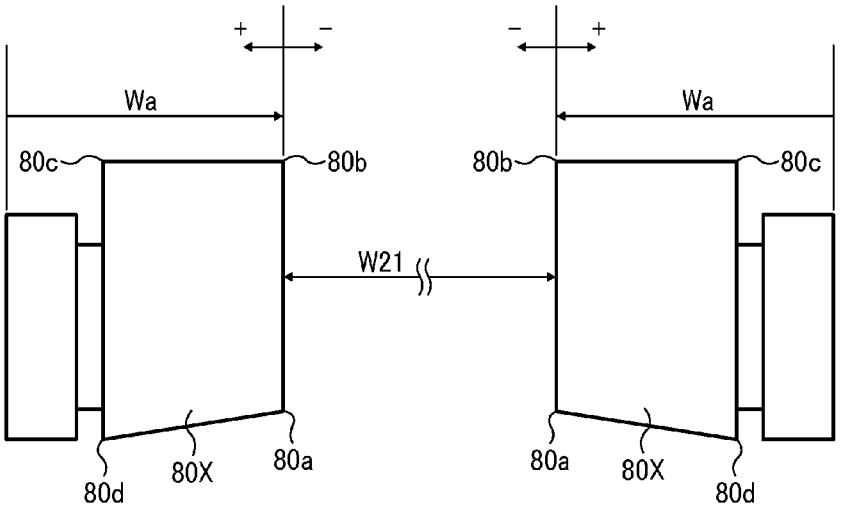
FIG. 20B is a diagram illustrating dimensions of a lateral end seal according to a comparative example.

FIG. 20A is a diagram illustrating dimensions of the lateral end seal 80 according to the above-described embodiment, used in the experiment, and FIG. 20B is a diagram illustrating dimensions of the comparative lateral end seal 80X used in the experiment. Other than widths Wa through We described below, the dimensions are similar to those shown in FIGS. 17 and 18.

Table 1 below shows conditions and evaluation results of embodiments 1 through 6 (E1 through E6 in table 1) according to the above-described embodiment shown in FIGS. 1 and 9 and those of comparative examples 1 and 2 (C1 and C2 in table 1).

TABLE 1

| | SEAL DIMENSIONS | | | AXIAL POSITION | CARRIER ADHESION | | | | OPENING |
|---|---|---|---|---|---|---|---|---|---|
| | Wa | Wb | Wc | OF ROLLER | FRONT END | | REAR END | | WIDTH |
| E1 | 0 | 3 | 8 | FRONT | — | — | 13 | GOOD | GOOD |
| E2 | 0 | 3 | 8 | FRONT | — | — | 17 | GOOD | GOOD |
| E3 | 0 | 3 | 8 | REAR | 18 | GOOD | 8 | GOOD | GOOD |
| E4 | 0 | 3 | 9 | REAR | 20-30 | GOOD | 12 | GOOD | GOOD |
| E5 | 0 | 3 | 7 | REAR | 23 | GOOD | 60-70 | ACCEPTABLE | GOOD |
| E6 | 0 | 3 | 8 | REAR | — | GOOD | — | GOOD | GOOD |
| C1 | 0 | — | — | REAR | 15 | GOOD | LEVEL 4 | BAD | GOOD |
| C2 | 2 | — | — | REAR | LEVEL 1 | GOOD | LEVEL 1 | GOOD | BAD |

Regarding "SEAL DIMENSIONS" in table 1, Wa represents a displacement of the axial inner periphery of the lateral end seal 80 downstream from the developing nip centerline 91. When the displacement Wa is "0", the development opening width W21 is 334 mm. The displacement Wa increases in positive (+) direction as the development opening width W21 increases from 334 mm.

The displacement Wa is "+2" only in comparative example 2, and the development opening width W21 is 338 mm since the lateral end seals 80X are provided at both axial ends.

In table 1, Wb represents a distance from the axial inner periphery of the developing nip regulating portion 86 to the axial inner periphery of the wide seal portion 85 in the axial direction in embodiments 1 through 6. The distance Wb is 3 mm in any of embodiments 1 through 6.

Further, Wc represents a distance from the corner 80*d* at the upstream end of the lateral end seal 80 to the corner 80*a* at the downstream end of the wide seal portion 85 in the sleeve rotation direction C in embodiments 1 through 6. The distance Wc is 6 mm in embodiment 4, 7 mm in embodiment 5, and 8 mm in other embodiments.

In table 1, "AXIAL POSITION OF ROLLER" means the position of the developing sleeve 51 and the magnet roller 55 relative to the casing 58 of the developing device 5. The developing sleeve 51 and the magnet roller 55 are attached to the casing 58, and there is backlash in the axial direction relative to the casing 58. Therefore, in the experiment, the developing sleeve 51 and the magnet roller 55 are pulled over to either the front end or the rear end of the device.

In "CARRIER ADHESION", the number of carrier adhesion and the judgment in five degrees are shown.

The number of carrier adhesion is rated in five levels and judged as follows.

Level 1: The number of carrier adhesion is 20 or less and deemed "GOOD".

Level 1: The number of carrier adhesion is 20 to 40 and deemed "GOOD".

Level 1: The number of carrier adhesion is 40 to 80 and deemed "ACCEPTABLE".

Level 4: Counting of the number of carrier adhesion is not feasible, and it is deemed "BAD".

In "OPENING WIDTH" in table 1, it is judged whether the lateral end seal 80 covers the axial end portion where the shape of the magnetic brush is unstable.

If the lateral end seal 80 does not fully cover the portion where the shape of the magnetic brush is unstable, toner scatters from the axial end portion. Additionally, when the difference between the charging roller width W23 and the development opening width W21 is reduced to keep the axial size of the developing device 5 compact, there is a risk that the scattering toner enters between the photoreceptor 1 and the charging gap roller 4*b* of the charging roller 4*a*. If toner enters between the photoreceptor 1 and the charging gap roller 4*b*, it causes fluctuations in the charging gap, damage to the surface of the photoreceptor 1, or both. Further, if the difference between the development opening width W21 and the effective charging width W24 on the photoreceptor 1 charged by the charging roller 4*a* is small, an insufficiently charged surface of the photoreceptor 1 faces the magnetic brush. As a result, there is a risk that toner adheres to the axial end portion of the photoreceptor 1 entirely in the circumferential direction.

As another variable, in embodiment 6, the amount of developer carried on the surface of the developing sleeve 51 about to reach the development range was set to the upper limit. Specifically, the position of the doctor blade 52 was adjusted so that the amount of developer carried was 46 mg/cm$^3$ adjacent to the front end, 52 mg/cm$^3$ adjacent to the axial center, and 47 mg/cm$^3$ adjacent to the rear end.

In embodiments 1 and 2, it was examined whether carrier adhesion was affected by whether or not the upper portion of the lateral end seal 80 is wound around the developing sleeve 51. In embodiment 1, the upper portion of the lateral end seal 80 did not conform to the surface of the developing sleeve 51 but stuck out. In embodiment 2, the upper portion of the lateral end seal 80 on the rear end side was in conformity to the surface of the developing sleeve 51. In embodiments 1 and 2, carrier adhesion on the front end side was not evaluated since the evaluation was conducted using the lateral end seal 80 on the rear end side.

According to the comparison results between embodiments 1 and 2, it is conceivable that carrier adhesion is affected by whether or not the upper portion of the lateral end seal 80 is wound around the developing sleeve 51.

Additionally, in embodiments 3 and 4, the upper portion of the lateral end seal 80 was in conformity to the surface of the developing sleeve 51 on both the front end side and the rear end side.

From the results of the experiment, it can be known that embodiments 1 through 6 can inhibit toner scattering and carrier adhesion to an acceptable level. In particular, the conditions of embodiments 3 and 4 are preferable.

Aspect A: Aspect A concerns a developing device, such as the developing device 5, that includes a developer bearer, such as the developing sleeve 51, to carry developer including magnetic carrier and toner to a development range, such as the developing nip 90, where the developer bearer faces a latent image bearer, such as the photoreceptor 1; a magnetic field generator, such as the magnet roller 55, provided inside the developer bearer and having multiple magnetic poles to generate magnetic fields; a casing including an opening, such as a development opening 58*e*, to partly expose the surface of the developer bearer in the development range; and a lateral end cover, such as the lateral end seal 80, to cover an axial end portion of the exposed surface of the developer bearer. The lateral end cover is disposed astride a development pole center (such as the developing nip centerline 91), where the density of magnetic flux on the surface of the developer bearer in the direction normal to the surface of the developer bearer is greatest inside the development range. The density of magnetic flux varies depending on the position in the direction of rotation of the developer bearer due to magnetic pole arrangement of the magnetic field generator. The lateral end cover covers the axial end portion of a magnetic brush of developer in or adjacent to the development range. The lateral end cover includes a wide portion, such as the wide seal portion 85, disposed upstream from the development pole center and having an axial inner periphery (such as the axial inner side 80*e*-80*f*) extending more to the axial inner side than an axial inner periphery (such as the axial inner side 80*a*-80*b*) of a downstream portion (such as the developing nip regulating portion 86) of the lateral end cover in the direction of rotation of the developer bearer. The downstream end of the wide portion is downstream from the upstream end of the development range in the direction of rotation of the developer bearer.

This configuration can inhibit toner from scattering from the axial end portion and adhesion of carrier to the latent image bearer while inhibiting increases in the axial size of the device from the following reasons.

Since the lateral end cover covers the axial end portion of the magnetic brush adjacent to the development range, the area of the surface of the developer bearer where the magnetic brush is not generated can be surely covered. Accordingly, toner scattering from the axial end portion of the opening can be inhibited. In aspect A, further the lateral end cover includes the wide portion disposed upstream from the development pole center. Thus, on the upstream side of the development pole center, the range covered by the lateral end cover extends more to the axial inner side than on the downstream side in the direction of rotation of the developer bearer.

Additionally, the downstream end of the wide portion is disposed downstream from the upstream end of the development range in the direction of rotation of the developer bearer, and the lateral end cover covers the magnetic brush in a range that contributes to image development if the lateral end cover is not present. With this configuration, the lateral end cover can cover the magnetic brush adjacent to the axial end of the developer bearer having the root inside the axial inner periphery of the lateral end cover and the end that might extend to the outer side beyond the axial inner periphery of the lateral end cover immediately after the magnetic brush rises. This configuration can reduce the risk that the magnetic brush in the axial end portion moves to the outer side beyond the axial inner periphery of the lateral end cover after the magnetic brush rises and the end thereof leaves the surface of the developer bearer. If developer at the end of that magnetic brush is retained between the surface of the latent image bearer and the face of the lateral end cover, carrier adhesion arises. However, this configuration can inhibit the carrier adhesion thus caused.

Additionally, on the downstream side of the development pole center in the direction of rotation of the developer bearer, the axial inner periphery of the lateral end cover is shifted to the outer side than that of the wide portion. In the portion where the axial inner periphery of the lateral end cover is on the outer side in the axial direction, the opening width between the lateral end covers at both axial ends can be wider. This configuration can obviate the necessity to increase the axial length of the developer bearer to keep the opening width wider than the desired largest development width, thus inhibiting increases in the axial size of the developing device.

Thus, aspect A can inhibit toner from scattering from the axial end portion and adhesion of carrier to the latent image bearer while inhibiting increases in the axial size of the device.

Aspect B: In the lateral end cover of aspect A, the axial inner periphery (i.e., the axial inner side 80*a*-80*b*) of the portion (i.e., the developing nip regulating portion 86) downstream from the wide portion in the direction of rotation of the developer bearer follows the direction of rotation of the developer bearer.

With this configuration, as described above, the axial inner periphery of the lateral end cover perpendicular to the line (such as the developing nip centerline 91) passing through the development pole center can determine the axial outer end of developer that contacts the surface of the latent image bearer. Accordingly, the axial length (such as the development opening width W21) of the range in which the magnetic brush of developer contacts the latent image bearer can be defined.

Aspect C: In aspect B or C, the wide portion (such as the wide seal portion 85) includes an inclined side (such as the inclined side 80*a*-80*f*) inclined relative to the axial direction such that the axial inner periphery is shifted successively to the axial inner side as the position moves from the downstream end (such as the corner 80*a*) of the wide portion to the upstream side in the direction of rotation of the developer bearer.

In this configuration, as described above, with the inclined side that is the axial inner periphery of the lateral end cover, developer can be immediately pulled over to the magnetic brush even if the developer enters between the latent image bearer and the lateral end cover. Thus, this configuration can inhibit the progress of developer entering between the lateral end cover and the surface of the latent image bearer and suppress carrier adhesion.

Aspect D: In aspect C, the upstream end (such as the corner 80*f*) of the inclined side is positioned upstream from the upstream end (such as the developing nip upstream end line 92) of the development range (such as the developing nip 90) in the direction of rotation of the developer bearer.

With this configuration, developer can be inhibited from entering between the lateral end cover and the surface of the latent image bearer on the upstream side from the inclined side. Although the inclined side can inhibit the progress of developer entering between the lateral end cover and the surface of the latent image bearer, there is a risk that the axial inner periphery upstream from the upstream end of the inclined side does not inhibit developer from entering therebetween. As in this aspect, with the upstream end of the inclined side disposed upstream from the development range, out of the wide portion (such as the wide seal portion 85), only the inclined side is within the development range. That is, since the axial inner periphery of the portion upstream from the inclined side is outside the development range, developer can be inhibited from entering between the latent image bearer and the lateral end cover.

Additionally, the axial inner periphery of the lateral end cover can be in contact with the latent image bearer, avoiding the portion where the developing nip width increases to the axial end portion. With this configuration, the axial inner periphery of the lateral end cover is not positioned in the spiraling developer that is about to go around to the axial end portion, and it can inhibit the progress of developer entering between the lateral end cover and the surface of the latent image bearer and suppress carrier adhesion.

Aspect E: The developing device according to any of aspects A through D further includes a development range entrance cover (such as the development range entrance seal 60) that covers the surface of the developer bearer upstream from the development range (such as the developing nip 90) in the direction of rotation of the developer bearer entirely in the axial direction. A downstream end side of the development range entrance cover in the direction of rotation of the developer bearer contacts the surface of the developer bearer, and a side (such as the side 80*d*-80*e*) defining the upstream end of the lateral end cover is oblique to the axial direction to contact the face of the development range entrance cover on the side of the latent image bearer.

According to aspect E, as described above, the side (such as the side 80*e*-80*f*) that defines the axial inner periphery of the lateral end cover and parallel to the sleeve rotation direction C is constantly inclined toward the latent image bearer. Then, this side can abut against the side of the latent image bearer, thus further inhibiting developer from entering between the lateral end cover and the latent image bearer.

Aspect F: In any of aspects A through E, the lateral end cover is attached to the casing of the developing device. In the direction normal to the surface of the developer bearer where the development range is positioned, the surface of the developer bearer is closer to the latent image bearer than a face (such as the attaching face 58*d*) of the casing to which the lateral end cover is attached.

With this configuration, as described above, the axial inner periphery of the lateral end cover contacts the surface of the latent image bearer, and the posture of the lateral end cover can be stable, thereby effectively inhibiting the occurrence of carrier adhesion.

Aspect G: A process cartridge, such as the image forming unit 6, removably installed in an image forming apparatus, includes at least the latent image bearer, the developing device according to any of aspects A through F, and a common unit casing to house those components.

As described above, this configuration can facilitate replacement of the developing device capable of inhibiting toner scattering and carrier adhesion in an image forming apparatus, thereby enhancing maintenance thereof.

Aspect H: The above-described developing device according to any of aspects A through F is incorporated in an image forming apparatus, such as the image forming apparatus 500, that includes at least the latent image bearer such as the photoreceptor 1, a charging member such as the charging device 40, and a latent image forming device such as a writing device.

As described above, this configuration can inhibit damage to the latent image bearer and adjacent components resulting from toner scattering and carrier adhesion, thereby extending the operational life of the image forming apparatus.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer to carry developer including magnetic carrier and toner to a development range where the developer bearer faces a latent image bearer;

a magnetic field generator provided inside the developer bearer to generate a magnetic flux on the surface of the developer bearer;

a casing including an opening to partly expose a surface of the developer bearer in the development range; and a lateral end cover to cover an axial end portion of the exposed surface of the developer bearer, the lateral end cover including a wide portion extending more to an axial inner side of the developer bearer than a downstream portion of the lateral end cover positioned downstream from the wide portion in a direction of rotation of the developer bearer, wherein a downstream end of the wide portion is downstream from an upstream end of the development range in the direction of rotation of the developer bearer, and wherein an inner periphery of the downstream portion of the lateral end cover in an axial direction of the developer bearer is shaped to follow the direction of rotation of the developer bearer.

2. The developing device according to claim 1, wherein the axial end portion covered with the lateral end cover is adjacent to the development range, the lateral end cover is disposed astride a development pole center where density of the magnetic flux in a direction normal to the surface of the developer bearer is greatest, and the wide portion is disposed upstream from the development pole center in the direction of rotation of the developer bearer.

3. The developing device according to claim 1, wherein the wide portion comprises an inclined side inclined relative to an axial direction of the developer bearer such that an upstream end of the inclined side in the direction of rotation of the developer bearer is shifted to the axial inner side from a downstream end of the inclined side in the direction of rotation of the developer bearer.

4. The developing device according to claim 3, wherein an upstream end of the inclined side is upstream from the upstream end of the development range in the direction of rotation of the developer bearer.

5. The developing device according to claim 3, wherein a corner of the lateral end cover defined by the inclined side and the direction of rotation of the developer bearer is obtuse.

6. The developing device according to claim 1, further comprising a development range entrance cover to cover the surface of the developer bearer upstream from the development range in the direction of rotation of the developer bearer entirely in an axial direction of the developer bearer, wherein a side defining a downstream periphery of the development range entrance cover in the direction of rotation of the developer bearer contacts the surface of the developer bearer, and a side defining an upstream periphery of the lateral end cover is oblique to the axial direction to contact a face of the development range entrance cover opposed to the latent image bearer.

7. The developing device according to claim 1, wherein the lateral end cover is attached to the casing of the developing device, and in the direction normal to the surface of the developer bearer where the development range is positioned, the surface of the developer bearer is closer to the latent image bearer than a face of the casing to which the lateral end cover is attached.

8. The developing device according to claim 1, wherein the lateral end cover is provided to either axial end portion of the developer bearer, the downstream portion includes an axial inner side parallel to the direction of rotation of the developer bearer, and a distance between the axial inner sides of the respective downstream portions is greater than a largest sheet width processed by the developing device.

9. A process cartridge removably installed in an image forming apparatus, the process cartridge comprising at least the latent image bearer;

the developing device according to claim 1; and a common unit casing to hold at least the latent image bearer and the developing device as a single unit.

10. An image forming apparatus comprising:

the latent image bearer;

a charging member to charge a surface of the latent image bearer; and the developing device according to claim 1.

11. A developing device comprising:

a developer bearer to carry developer including magnetic carrier and toner to a development range where the developer bearer faces a latent image bearer;

a magnetic field generator provided inside the developer bearer to generate a magnetic flux on the surface of the developer bearer;

a casing including an opening to partly expose a surface of the developer bearer in the development range; and a cover means to cover an axial end portion of the exposed surface of the developer bearer, the axial end portion adjacent to the development range and astride a development pole center where density of the magnetic flux in a direction normal to the surface of the developer bearer is greatest, wherein, on an upstream side of the development pole center and downstream from an upstream end of the development range in a direction of rotation of the developer bearer, the cover means covers an area extending more to an axial inner side of the developer bearer than a downstream side of the development pole center, and wherein, an inner periphery of the downstream portion of the lateral end cover in an axial direction of the developer bearer is shaped to follow the direction of rotation of the developer bearer.

12. A method of attaching a lateral end cover to a developing device, the lateral end cover to cover an axial end portion of an exposed surface of a developer bearer, the lateral end cover including a wide portion extending more to an axial inner side of the developer bearer than a downstream portion of the lateral end cover positioned downstream from the wide portion in a direction of rotation of the developer bearer, the wide portion including an inclined side inclined relative to an axial direction of the developer bearer such that an upstream end of the inclined side in the direction of rotation of the developer bearer is shifted to the axial inner side from a downstream end of the inclined side in the direction of rotation of the developer bearer, the downstream portion including an axial inner side parallel to the direction of rotation of the developer bearer, the method comprising:

aligning a point of intersection between the inclined side and the axial inner side with a development pole center where density of the magnetic flux in a direction normal to the surface of the developer bearer is greatest; and attaching the lateral end cover to the development device.

* * * * *